US008498558B2

(12) United States Patent
Yoshikawa et al.

(10) Patent No.: US 8,498,558 B2
(45) Date of Patent: Jul. 30, 2013

(54) IMAGE FORMING APPARATUS, CONTROL DEVICE, DETECTING METHOD OF REFERENCE INDEX ON TRANSFER BODY, AND COMPUTER READABLE MEDIUM

(75) Inventors: Hayato Yoshikawa, Yokohama (JP); Yasuhiro Arai, Yokohama (JP); Ryuji Fujiki, Yokohama (JP); Kenji Koizumi, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 319 days.

(21) Appl. No.: 12/952,987

(22) Filed: Nov. 23, 2010

(65) Prior Publication Data

US 2011/0293299 A1 Dec. 1, 2011

(30) Foreign Application Priority Data

May 26, 2010 (JP) ..... 2010-120542

(51) Int. Cl.
*G03G 15/01* (2006.01)

(52) U.S. Cl.
USPC ..... 399/301

(58) Field of Classification Search
USPC ..... 399/43, 49, 301
See application file for complete search history.

(56) References Cited

FOREIGN PATENT DOCUMENTS

| | | | |
|---|---|---|---|
| JP | 2000-066562 | A | 3/2000 |
| JP | 2004-264379 | A | 9/2004 |
| JP | 2009-128440 | A | 6/2009 |

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

An image forming apparatus includes: a latent image forming unit forming a latent image; a transfer body on which a reference index for setting an output start time point of image data is formed; a detecting unit facing the reference index and outputting a detection signal changing in accordance with passing of the reference index; a measuring unit measuring change duration time; and a controller controlling the output start time point with the detection signal. The controller starts a first period during which change of the detection signal is ignored, according to first change of the detection signal, starts a second period after the first period, regards change of the detection signal occurring first in the second period as a reference of the output start time point if the change duration time is longer than a predetermined period, and ignores change of the detection signal after the change occurring first.

9 Claims, 15 Drawing Sheets

IMAGE FORMING APPARATUS, CONTROL DEVICE, DETECTING METHOD OF REFERENCE INDEX ON TRANSFER BODY, AND COMPUTER READABLE MEDIUM

CROSS REFERENCE TO RELATED APPLICATIONS

This application is based on and claims priority under 35 USC §119 from Japanese Patent Application No. 2010-120542 filed May 26, 2010.

BACKGROUND

1. Technical Field

The present invention relates to an image forming apparatus, a control device, a detecting method of a reference index on a transfer body, and a computer readable medium storing a program.

2. Related Art

As an image forming apparatus, such as a copier and a printer, using an electrophotographic method, there is known a color image forming apparatus that sequentially superimposes color toner images on an endless intermediate transfer belt or an endless sheet transport belt, thereby to form a color image.

SUMMARY

According to an aspect of the present invention, there is provided an image forming apparatus including: a latent image forming unit that emits light in accordance with image data on receiving input of the image data, and that scans and exposes an image carrier with the light, to form a latent image on the image carrier; a transfer body on which a toner image is transferred and a reference index is formed, the toner image being formed by developing the latent image on the image carrier, the reference index serving as a reference for setting an output start time point from which the image data is outputted to the latent image forming unit; a detecting unit that is arranged so as to face the reference index formed on the transfer body, and that outputs a detection signal changing in accordance with passing of the reference index; a measuring unit that measures change duration time from a first change occurring in the detection signal outputted from the detecting unit to a second change occurring after the first change; and a controller that controls, by using the detection signal outputted from the detecting unit, the output start time point of the image data to the latent image forming unit. The controller starts a first period having a first time length during which a change of the detection signal is ignored, according to the first change occurring in the detection signal, starts a second period having a second time length according to elapsing of the first period, regards a change of the detection signal occurring for the first time in the second period as the reference of the output start time point of the image data, if the change duration time measured by the measuring unit is longer than a predetermined time period, and ignores a change of the detection signal after the change occurring for the first time in the second period occurs.

BRIEF DESCRIPTION OF THE DRAWINGS

Exemplary embodiment(s) of the present invention will be described in detail based on the following figures, wherein:

FIG. 8-1 is a flowchart showing a procedure of processing when the reference signal generator generates the belt reference signal;

FIG. 8-2 is a flowchart showing a procedure of processing when the reference signal generator generates the belt reference signal;

DETAILED DESCRIPTION

An exemplary embodiment of the present invention will be described below in detail with reference to the accompanying drawings.

<Description of Image Forming Apparatus>

Figure 1:
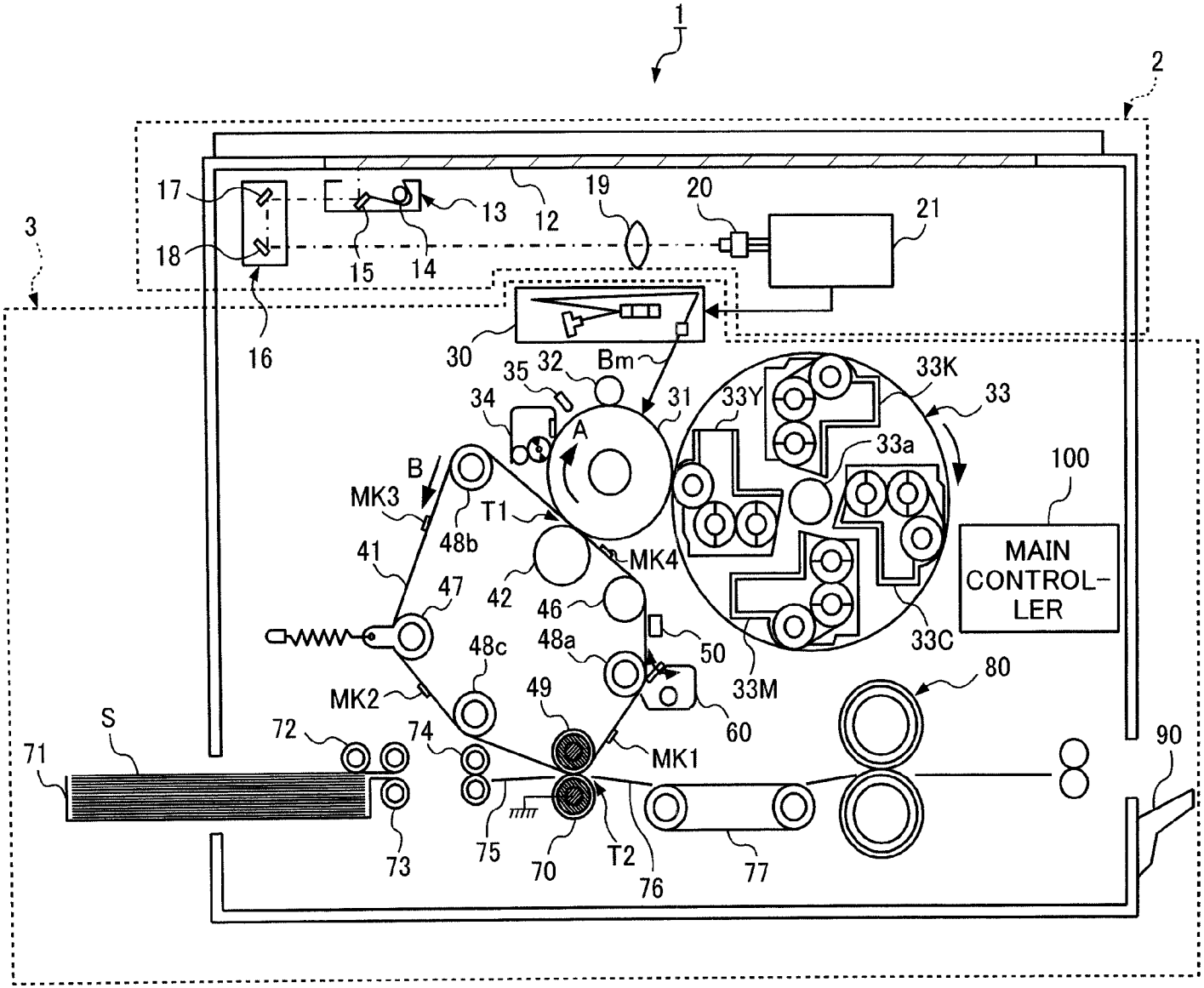
FIG. 1 is a diagram showing an image forming apparatus to which the exemplary embodiment is applied.

FIG. 1 is a diagram showing an image forming apparatus 1 to which the present exemplary embodiment is applied. The image forming apparatus 1 shown in FIG. 1 includes an image reading part 2 and an image forming part 3.

<Description of Image Reading Part>

The image reading part 2 includes: a transparent platen glass 12 on which a document (not shown) to be copied is put; a document lighting unit 13 that is movable in the lateral direction in FIG. 1 and is configured by a light source 14 illuminating the document and a first reflection mirror 15 reflecting light having been reflected by the document; and a mirror unit 16 that includes a second reflection mirror 17 and a third reflection mirror 18 reflecting light from the document lighting unit 13. Furthermore, the image reading part 2 includes: an image-forming lens 19 that is arranged on an optical path of the reflected light from the mirror unit 16; and a light receiving portion 20 that is formed of a charge coupled device (CCD) receiving the reflected light with which an image is formed by the image-forming lens 19.

The document lighting unit 13 irradiates the document with light from below the platen glass 12 while moving in the lateral direction in FIG. 1, and guides the reflected light from the document to the mirror unit 16. The mirror unit 16 guides the reflected light from the document lighting unit 13 to the image-forming lens 19, and the image-forming lens 19 then forms an image with the reflected light from the document on the light receiving portion 20. The light receiving portion 20 reads the reflected light from the document as analog signals (read image signals) of red (R), green (G) and blue (B), and sends the read image signals having been read to an image processor 21.

The image processor 21 converts the read image signals received from the light receiving portion 20 into digital data (AD conversion). Additionally, the image processor 21 performs various types of data processing, such as color conversion to yellow (Y), magenta (M), cyan (C) and black (K), density correction and scaling correction, and outputs the processed data to an optical scanning device 30 as image data for writing (digital data).

<Description of Image Forming Part>

The image forming part 3 includes: a photoconductive drum 31 as an example of an image carrier that rotates in the direction of an arrow A; a charging device 32 that charges the photoconductive drum 31; the optical scanning device 30 that irradiates the photoconductive drum 31 with a laser beam Bm modulated in accordance with image data for writing from the image processor 21; a rotary developing device 33 in which four developing devices 33Y, 33M, 33C and 33K respectively containing color toners of Y, M, C and K are installed. The rotary developing device 33 rotates around a rotation shaft 33*a*, and sets each of the developing devices 33Y, 33M, 33C and 33K to a position facing the photoconductive drum 31. Furthermore, the image forming part 3 includes: a drum cleaner 34 that removes residual toner on the photoconductive drum 31; and a discharge lamp 35 that discharges electricity of the photoconductive drum 31 before charging by the charging device 32.

Additionally, the image forming part 3 includes a main controller 100 as an example of a controller that controls overall operations of the image forming apparatus 1.

Furthermore, the image forming part 3 includes an intermediate transfer belt 41 as an example of a transfer body that is formed of a film-like endless belt and is arranged so as to be in contact with the surface of the photoconductive drum 31. The intermediate transfer belt 41 is provided with tension by a drive roll 46 rotating the intermediate transfer belt 41, a tension roll 47 stabilizing tension of the intermediate transfer belt 41, idler rolls 48*a* to 48*c* driven to rotate, and a back-up roll 49 for secondary transfer to be described later, and rotates in the direction of an arrow B. Additionally, a primary transfer roll 42 is arranged on the rear surface side of the intermediate transfer belt 41, at a primary transfer portion T1 where the intermediate transfer belt 41 is in contact with the photoconductive drum 31. The primary transfer roll 42 is arranged so as to be in pressure contact with the photoconductive drum 31 with the intermediate transfer belt 41 interposed therebetween. To the primary transfer roll 42, a voltage (a primary transfer bias) having a polarity opposite to the charging polarity of the toner (for example, a minus polarity) is applied. Thereby, the intermediate transfer belt 41 electrostatically attracts the toner images formed on the photoconductive drum 31, onto the intermediate transfer belt 41 in sequence, and forms superimposed toner images on the intermediate transfer belt 41.

Additionally, at a secondary transfer portion T2 where the intermediate transfer belt 41 faces a transportation route of a sheet S, a secondary transfer roll 70 is arranged on a toner held surface side (outside) of the intermediate transfer belt 41 so as to be contactable with and separable from the intermediate transfer belt 41, and the back-up roll 49 is arranged on the rear surface side (inside) of the intermediate transfer belt 41 to form a counter electrode to the secondary transfer roll 70.

When color toner images are formed, the secondary transfer roll 70 is set at a position separated from the intermediate transfer belt 41 until toner images except for the last color (color toner images of Y, M and C) pass an opposing portion to the secondary transfer roll 70. After that, the secondary transfer roll 70 is set at a position in contact with the intermediate transfer belt 41 in accordance with timing at which toner images including the last color (color toner images obtained by superimposing K on Y, M and C) are primarily transferred and transported to the secondary transfer portion T2. Then, the secondary transfer roll 70 is brought into pressure contact with the back-up roll 49 with the intermediate transfer belt 41 interposed therebetween, and a secondary transfer bias is formed between the secondary transfer roll 70 and the back-up roll 49. Thereby, the toner images are secondarily transferred onto the sheet S being transported to the secondary transfer portion T2.

In addition, on the downstream side of the secondary transfer portion T2 in the intermediate transfer belt 41, a belt cleaner 60 is arranged at a position facing the idler roll 48*a* with the intermediate transfer belt 41 interposed therebetween. The belt cleaner 60 is configured so as to be contactable with and separable from the intermediate transfer belt 41. When color toner images are formed, the belt cleaner 60 is retracted to a position separated from the intermediate transfer belt 41 until toner images except for the last color (color toner images of Y, M and C) pass an opposing portion to the belt cleaner 60. Then, the belt cleaner 60 is set at a position in contact with the intermediate transfer belt 41 at a time point after the color toner images of Y, M and C pass the opposing portion to the belt cleaner 60. Thereby, the belt cleaner 60 removes transfer residual toner after the toner images including the last color (color toner images obtained by superimposing K on Y, M and C) are secondarily transferred.

Additionally, on the surface of the intermediate transfer belt 41, stickers for position detection MK1 to MK4 as an example of a reference index that serves as a reference for positioning color toner images of Y, M, C and K on the intermediate transfer belt 41 (that is, a reference for an output start time point when the image data for writing is outputted to the optical scanning device 30) are arranged at plural positions (here, four positions). Furthermore, at a position on the downstream side of the belt cleaner 60, a sticker detection unit 50 as an example of a detecting unit that outputs a sticker detection signal for detecting passing of the stickers for position detection MK1 to MK4 is arranged. In this image forming apparatus 1, timing to write latent images corresponding to colors of Y, M, C and K onto the photoconductive drum 31 is controlled by using the sticker detection signal outputted by the sticker detection unit 50.

<Description of Stickers for Position Detection>

Figure 2:
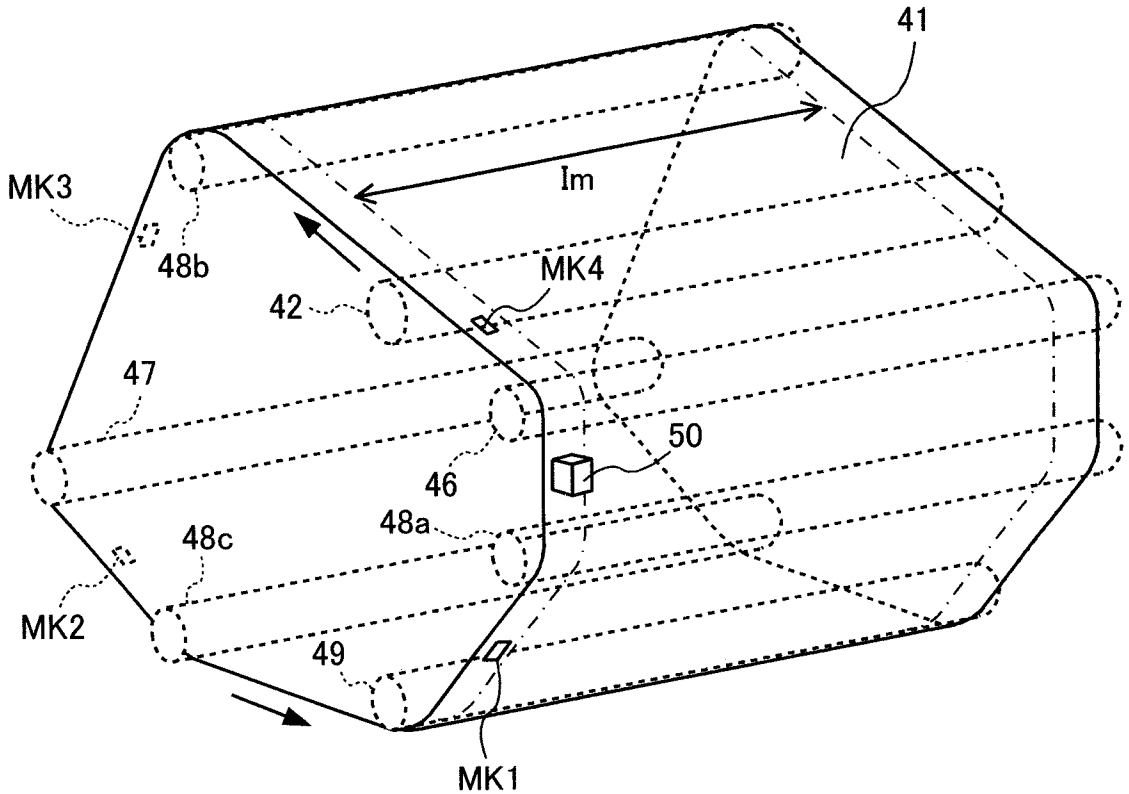
FIG. 2 is a diagram illustrating arrangement positions of the stickers for position detection on the surface of the intermediate transfer belt.

FIG. 2 is a diagram illustrating arrangement positions of the stickers for position detection MK1 to MK4 on the surface of the intermediate transfer belt 41. As shown in FIG. 2, the stickers for position detection MK1 to MK4 are arranged at four positions having substantially equal intervals therebetween in a proceeding direction (a circumferential direction indicated by an arrow in FIG. 2) of the intermediate transfer belt 41. As for the direction (width direction) orthogonal to the proceeding direction of the intermediate transfer belt 41, the stickers for position detection MK1 to MK4 are arranged in an outer region of a region (hereinafter, referred to as a "transfer region Im") where an image is transferred on the intermediate transfer belt 41. Corresponding to this, the sticker detection unit 50 is arranged in a region facing the stickers for position detection MK1 to MK4 placed in the outer region of the transfer region Im.

The stickers for position detection MK1 to MK4 according to the present exemplary embodiment are formed of a material having different light reflectivity from that of the surface of the intermediate transfer belt 41. Thus, the sticker detection unit 50 outputs the sticker detection signal changing in accordance with the difference in light reflectivity between the surface of the intermediate transfer belt 41 and the stickers for position detection MK1 to MK4. Alternatively, the stickers for position detection MK1 to MK4 may be formed of a material having different light transmittance from that of the surface of the intermediate transfer belt 41, and the sticker detection unit 50 may output the sticker detection signal changing in accordance with the difference in light transmittance.

Additionally, as a sheet transportation system, the image forming part 3 includes: a sheet container 71 in which the sheet S is placed; a pick-up roll 72 that picks up the sheet S stacked in the sheet container 71; transport rolls 73 that transport the sheet S having been picked up by the pick-up roll 72; registration rolls 74 that adjust transportation timing of the sheet S to the secondary transfer portion T2; a transport member 75 that guides the sheet S to the secondary transfer portion T2; and a guide 76 and a sheet transport belt 77 that guide the sheet S after the secondary transfer. On the downstream side of the sheet transport belt 77 in the sheet transport direction, the image forming part 3 also includes a fixing device 80 that is configured by a fixing roll and a pressurizing roll, and that fixes a toner image having been transferred onto the sheet S, by applying heat and pressure thereto. Furthermore, on the downstream side of the fixing device 80 in the sheet transport direction, the image forming part 3 includes a discharged sheet container 90 that accumulates the sheet S discharged outside.

<Description of Image Forming Operation in Image Forming Apparatus>

Next, a description will be given of an image forming operation in a case where copy processing is performed, as an example of image forming operations performed by the image forming apparatus 1 according to the present exemplary embodiment.

When a copy start key (not shown) of the image forming apparatus 1 is turned on by a user, the document put on the platen glass 12 is first illuminated by the light source 14 of the document lighting unit 13. The reflected light from the document is reflected by the first reflection mirror 15 of the document lighting unit 13 and the second reflection mirror 17 and the third reflection mirror 18 of the mirror unit 16. With the reflected light, an image is formed on the light receiving portion 20 by the image-forming lens 19. The light receiving portion 20 reads the reflected light from the document as analog signals (read image signals) of R, G and B. The read image signals having been read by the light receiving portion 20 are converted into image data for writing (digital data) of Y, M, C and K by the image processor 21, and are send to the optical scanning device 30. In the optical scanning device 30, a laser drive device (a laser driver: not shown) generates a laser drive signal in accordance with the image data for writing having been sent from the image processor 21, and drives a laser light source (not shown). Thereby, the photoconductive drum 31 is scanned and exposed with the laser beam Bm from the optical scanning device 30, the laser beam Bm being turned on and off in accordance with the image data for writing.

The photoconductive drum 31 is driven to rotate in the direction of the arrow A, and the surface thereof is charged at a predetermined minus potential by the charging device 32. In this state, the photoconductive drum 31 is scanned and exposed with the laser beam Bm from the optical scanning device 30 as an example of a latent image forming unit, the laser beam Bm being turned on and off in accordance with the image data for writing, and thereby, an electrostatic latent image is written onto the photoconductive drum 31. In this event, if the electrostatic latent image written on the photoconductive drum 31 is one corresponding to image information of yellow (Y), the rotary developing device 33 sets the developing device 33Y containing the Y toner at the position facing the photoconductive drum 31. Thereby, this electrostatic latent image is developed with the Y toner by the developing device 33Y, and a Y toner image is formed on the photoconductive drum 31. Then, the Y toner image formed on the photoconductive drum 31 is transferred onto the intermediate transfer belt 41 by the primary transfer bias applied to the primary transfer roll 42 at the primary transfer portion T1 where the photoconductive drum 31 and the intermediate transfer belt 41 face with each other. Meanwhile, residual toner on the photoconductive drum 31 after the primary transfer (transfer residual toner) is removed by the drum cleaner 34.

When a color image formed of toner images of plural colors is formed in the image forming apparatus 1, formation of color toner images on the photoconductive drum 31 and the primary transfer of the color toner images onto the intermediate transfer belt 41 are repeated by the number of colors. For example, when a full color image on which toner images of four colors are superimposed is formed, color toner images of Y, M, C and K are sequentially formed on the photoconductive drum 31, and the toner images are primarily transferred onto the intermediate transfer belt 41 in sequence. Thereby, every time the photoconductive drum 31 makes a rotation, the color toner images of Y, M, C and K are superimposed on the intermediate transfer belt 41.

In this case, the secondary transfer roll 70 is set at the position separated from the intermediate transfer belt 41 until toner images except for the last color (color toner images of Y, M and C) pass the opposing portion to the secondary transfer roll 70. After that, the secondary transfer roll 70 is set at the position in contact with the intermediate transfer belt 41 in accordance with timing at which toner images including the last color (color toner images obtained by superimposing K on Y, M and C) are primarily transferred and transported to the secondary transfer portion T2. Meanwhile, the belt cleaner 60 is set at the position in contact with the intermediate transfer belt 41 at a time point after the color toner images of Y, M and C pass the opposing portion to the belt cleaner 60. Thereby, the belt cleaner 60 removes transfer residual toner after the toner images including the last color (color toner images obtained by superimposing K on Y, M and C) are secondarily transferred.

On the other hand, when a single color image (for example, a monochrome image) is formed in the image forming apparatus 1, a toner image of one color is formed on the photoconductive drum 31, primarily transferred onto the intermediate transfer belt 41, and then, secondarily transferred onto the sheet S immediately.

In this case, the secondary transfer roll 70 is set at the position in contact with the intermediate transfer belt 41 in accordance with timing at which the toner image of one color is primarily transferred and transported to the secondary transfer portion T2. Meanwhile, the belt cleaner 60 is immediately set at the position in contact with the intermediate transfer belt 41, and removes transfer residual toner remaining after the toner image is secondarily transferred.

Meanwhile, in the sheet transportation system, the sheets S are picked up by the pick-up roll 72 from the sheet container 71, transported one-by-one by the transport rolls 73, and then transported to the position of the registration rolls 74. After that, the sheet S is supplied to the secondary transfer portion T2 so as to accord with timing at which the toner images on the intermediate transfer belt 41 reach the secondary transfer portion T2, and is sandwiched between the back-up roll 49 and the secondary transfer roll 70 through the intermediate transfer belt 41. On this occasion, in the secondary transfer portion T2, the action of the transfer electric field formed between the secondary transfer roll 70 and the back-up roll 49 by the secondary transfer bias applied to the back-up roll 49 causes the toner images held on the intermediate transfer belt 41 to be secondarily transferred (collectively transferred) onto the sheet S.

After that, the sheet S on which the toner images are transferred is transported to the fixing device 80 by the guide 76 and the sheet transport belt 77 to make the toner images fixed, and is then discharged to the discharged sheet container 90.

<Description of Output Timing Control of Image Data for Writing>

Next, a description will be given of control of timing at which the image data for writing is outputted from the image processor 21 to the optical scanning device 30.

Figure 3:
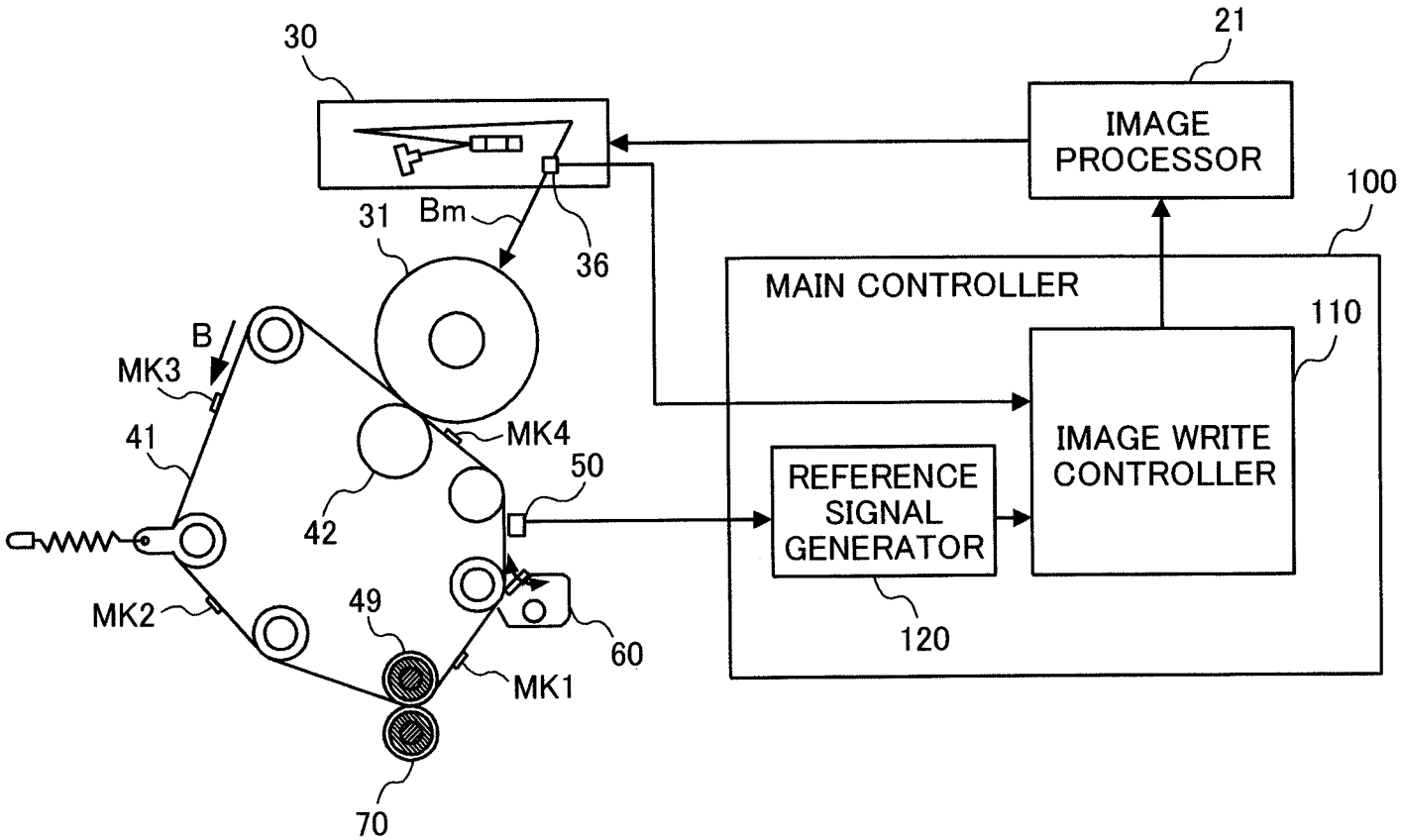
FIG. 3 is a diagram illustrating a configuration to control output timing of the image data for writing to the optical scanning device.

FIG. 3 is a diagram illustrating a configuration to control output timing of the image data for writing to the optical scanning device 30. As shown in FIG. 3, the main controller 100 generating various types of control signals for controlling operations of the units in the image forming apparatus 1 (see FIG. 1) is configured by a reference signal generator 120 and an image write controller 110. The reference signal generator 120 acquires the sticker detection signal about one of the stickers for position detection MK1 to MK4 outputted by the sticker detection unit 50, generates a "belt reference signal TRO" on the basis of the acquired sticker detection signal, and outputs the belt reference signal TRO to the image write controller 110. Meanwhile, the image write controller 110 controls the output timing of the image data for writing by using the belt reference signal TRO generated by the reference signal generator 120 and a signal (hereinafter, referred to as an "SOS signal") from an SOS (Start of Scan) sensor 36 provided in the optical scanning device 30.

As described above, the "belt reference signal TRO" is generated on the basis of the sticker detection signal about one of the stickers for position detection MK1 to MK4 outputted by the sticker detection unit 50, and is a signal serving as a reference for the output timing (the output start time point) of the image data for writing in the second scanning direction, when color toner images of Y, M, C and K are sequentially superimposed on the intermediate transfer belt 41.

Meanwhile, the "SOS signal" is a signal outputted when the SOS sensor 36 arranged on the optical path of the laser beam Bm in the optical scanning device 30 detects passing of the laser beam Bm before the laser beam Bm for each scan line scans the surface of the photoconductive drum 31, and is a signal serving as a reference for the output timing of the image data for writing for each scan line in the first scanning direction.

Figure 4:
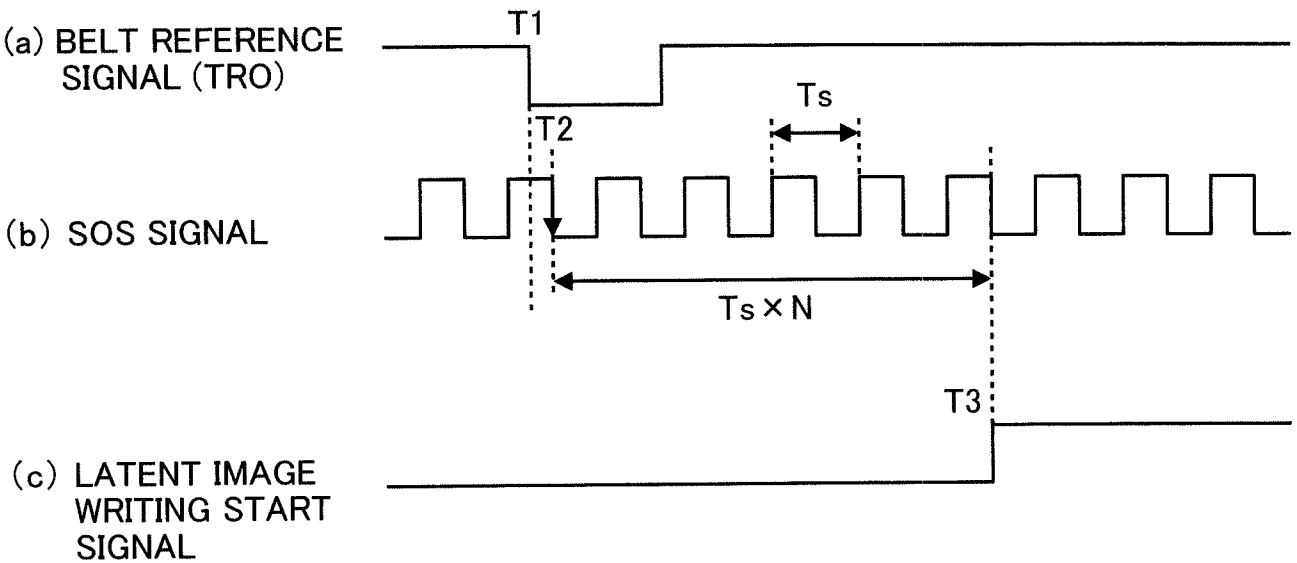
FIG. 4 is a diagram illustrating the output timing of the image data for writing controlled by the image write controller.

Next, FIG. 4 is a diagram illustrating the output timing of the image data for writing controlled by the image write controller 110. As shown in FIG. 4, when an electrostatic latent image is written onto the photoconductive drum 31, the image write controller 110 of the main controller 100 starts counting the number of falling (T2) of the SOS signal ((b) in FIG. 4) from a time point (T1) at which the belt reference signal TRO ((a) in FIG. 4) generated by the reference signal generator 120 falls. Then, the image write controller 110 raises a "latent image writing start signal" ((c) in FIG. 4) that is a signal to instruct a writing start in the second scanning direction (T3), at a time point (period of SOS signal Ts×N) when the counted value of the falling of the SOS signal reaches a predetermined value N (N: integer).

With this operation, the image write controller 110 causes the image processor 21 to output the image data for writing of Y, M, C or K to be a target for writing to the optical scanning device 30, after counting a predetermined number of pixel clocks from the rising of the latent image writing start signal.

<Description of Generation of Belt Reference Signal>

Next, a description will be given of generation of the belt reference signal TRO by the reference signal generator 120.

As described above, the reference signal generator 120 generates the belt reference signal TRO serving as a reference when the image data for writing is outputted from the image processor 21 to the optical scanning device 30, on the basis of the sticker detection signal about one of the stickers for position detection MK1 to MK4 outputted by the sticker detection unit 50.

Figure 5:
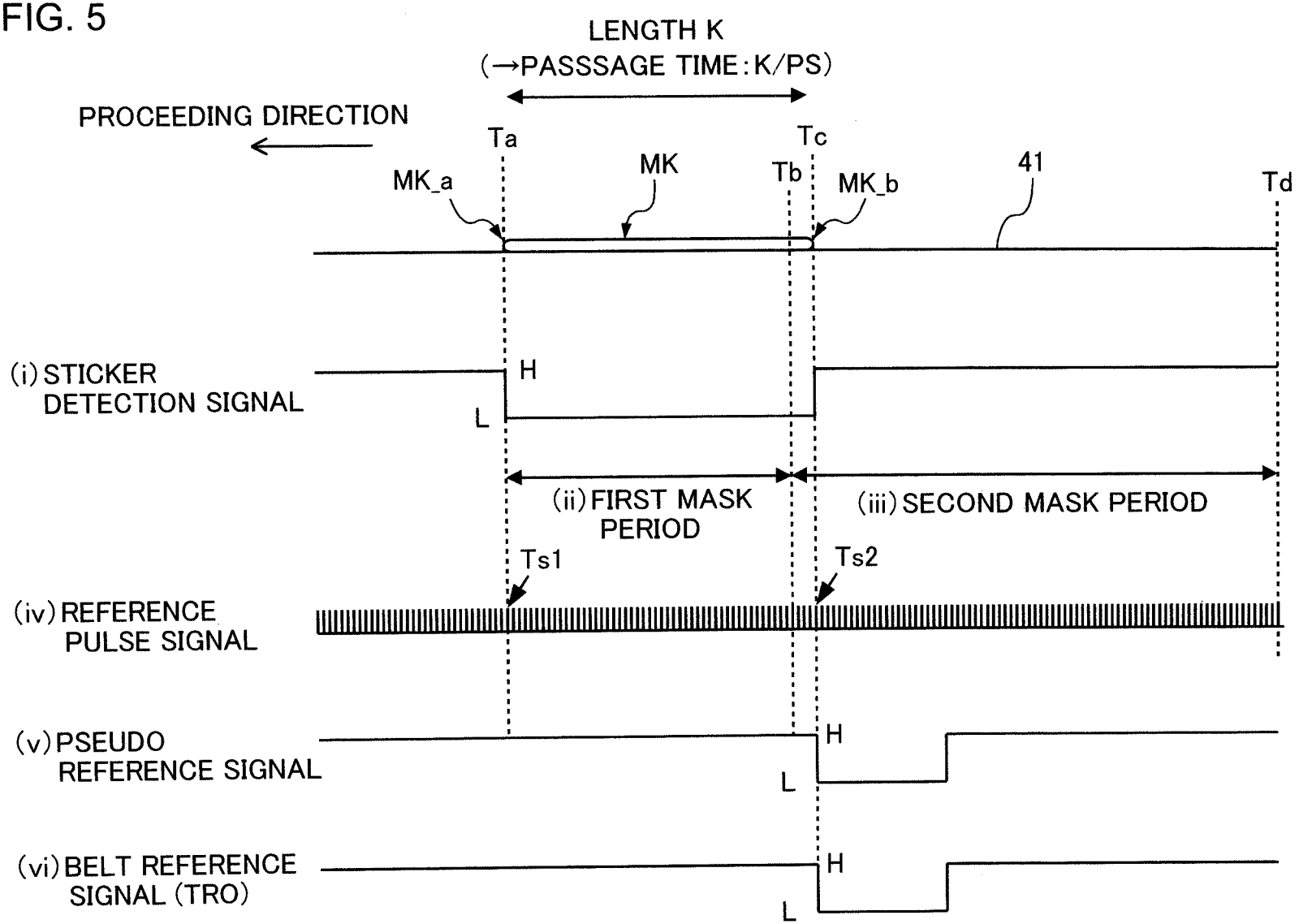
FIG. 5 is a diagram for illustrating usage of the sticker detection signal outputted from the sticker detection unit when the reference signal generator generates the belt reference signal.

Next, FIG. 5 is a diagram for illustrating usage of the sticker detection signal outputted from the sticker detection unit 50 when the reference signal generator 120 generates the belt reference signal TRO. As shown in FIG. 5, the reference signal generator 120 sets a first mask period ((ii) in FIG. 5) as an example of a first period, at a time point (Ta) when the sticker detection unit 50 detects a front end portion (MK_a) of one of the stickers for position detection MK1 to MK4 (hereinafter, referred to as the "sticker for position detection MK") and when the signal level of the sticker detection signal ((i) in FIG. 5) outputted from the sticker detection unit 50 changes from a high level ("H") to a low level ("L") (makes a first change or is asserted).

At the same time, the reference signal generator 120 starts measuring a reference pulse signal ((iv) in FIG. 5) from the time point (Ta (=Ts1)) when the signal level of the sticker detection signal changes from "H" to "L." Here, the "reference pulse signal" is a pulse signal that oscillates with a predetermined period and that is used for measuring the length of a period during which the sticker detection signal is active (here, the period during which the signal level is "L": hereinafter, referred to as an "active period").

This first mask period ((ii) in FIG. 5) is set to have a time length (a first time length) shorter than a time period that is required for the sticker for position detection MK, whose length in the proceeding direction of the intermediate transfer belt 41 is K, to pass the sticker detection unit 50. That is, the first mask period (Tb−Ta) is set to be shorter than K/PS where PS denotes a process speed (equal to a moving speed of the intermediate transfer belt 41) (Tb−Ta<K/PS). For this reason, a time point Tb at which the first mask period ends is earlier than a time point Tc at which a rear end portion (MK_b) of the sticker for position detection MK passes the sticker detection unit 50.

Then, in the first mask period, the reference signal generator 120 regards a change (change in the signal level between "H" and "L") of the sticker detection signal ((i) in FIG. 5) as invalid (ignores the change).

Subsequently, the reference signal generator 120 sets a second mask period ((iii) in FIG. 5) as an example of a second period having a second time length from the time point Tb at which the first mask period ends. In this second mask period ((iii) in FIG. 5), the reference signal generator 120 regards only a change in the signal level (a change occurring for the first time in the second mask period: a second change or a negation) from "L" to "H" detected for the first time after the start of the second mask period as valid, and regards the subsequent changes in the sticker detection signal ((i) in FIG. 5) as invalid (ignores the changes). Then, at the time point (Tc) when the signal level is changed from "L" to "H" (negated) for the first time after the start of the second mask period, the reference signal generator 120 generates a pseudo reference signal ((v) in FIG. 5). At the same time, the reference signal generator 120 finishes measuring the reference pulse signal ((iv) in FIG. 5) at the time point (Tc (=Ts2)) when the signal level of the sticker detection signal is negated from "L" to "H," and calculates the length (Ts2−Ts1) of the active period of the sticker detection signal.

If the active period (Ts2−Ts1) of the sticker detection signal is longer than a time period set in advance (a predetermined time period) (hereinafter, referred to as an "active set time period"), the reference signal generator 120 outputs the belt reference signal TRO ((vi) in FIG. 5: see FIG. 4) to the image write controller 110, in synchronization with the generated pseudo reference signal ((v) in FIG. 5). That is, the reference signal generator 120 causes the signal level of the belt reference signal TRO, which is to be outputted to the image write controller 110, to change from "H" to "L" (be asserted), in synchronization with an assertion of the pseudo reference signal. In this case, the time point Tb at which the first mask period ((ii) in FIG. 5) ends is earlier than the time point Tc at which the rear end portion (MK_b) of the sticker for position detection MK passes the sticker detection unit 50, as described above. Thus, the change in the signal level from "L" to "H" detected for the first time after the start of the second mask period ((iii) in FIG. 5) is caused by the rear end portion (MK_b) of the sticker for position detection MK.

On the other hand, if the active period (Ts2−Ts1) of the sticker detection signal is shorter than the active set time period, the reference signal generator 120 does not output the belt reference signal TRO ((vi) in FIG. 5: see FIG. 4). That is, the reference signal generator 120 does not cause the signal level of the belt reference signal TRO to change from "H" to "L" (be asserted). This is because, in this case, the time point Tb at which the first mask period ((ii) in FIG. 5) ends and the second mask period ((iii) in FIG. 5) starts is later than the time point Tc at which the rear end portion (MK_b) of the sticker for position detection MK passes the sticker detection unit 50, and thus the change in the signal level from "L" to "H" detected for the first time after the start of the second mask period ((iii) in FIG. 5) may not be caused by the rear end portion (MK_b) of the sticker for position detection MK.

The second time length set for the second mask period is set to be a time length shorter than a time period that is required from the start of the second mask period to an arrival of the front end portion (MK_a) of the next sticker for position detection MK to the arrangement position of the sticker detection unit 50. Thus, the first mask period that is set according to the next passing sticker for position detection MK after the second mask period having been set according to one of the stickers for position detection MK is set according to the front end portion (MK_a) of this next passing sticker for position detection MK.

As described above, the reference signal generator 120 of the main controller 100 detects the rear end portion (MK_b) of the sticker for position detection MK on condition that the active period (Ts2−Ts1) of the sticker detection signal is longer than the time period set in advance (the active set time period). Thereby, the reference signal generator 120 generates the belt reference signal TRO, and outputs the belt reference signal TRO to the image write controller 110. Thus, as shown in FIG. 4 described above, the image write controller 110 causes the image processor 21 to output the image data for writing of Y, M, C or K to be a target for writing to the optical scanning device 30, with the belt reference signal TRO as a reference.

<Description of Configuration of Reference Signal Generator>

Figure 6:
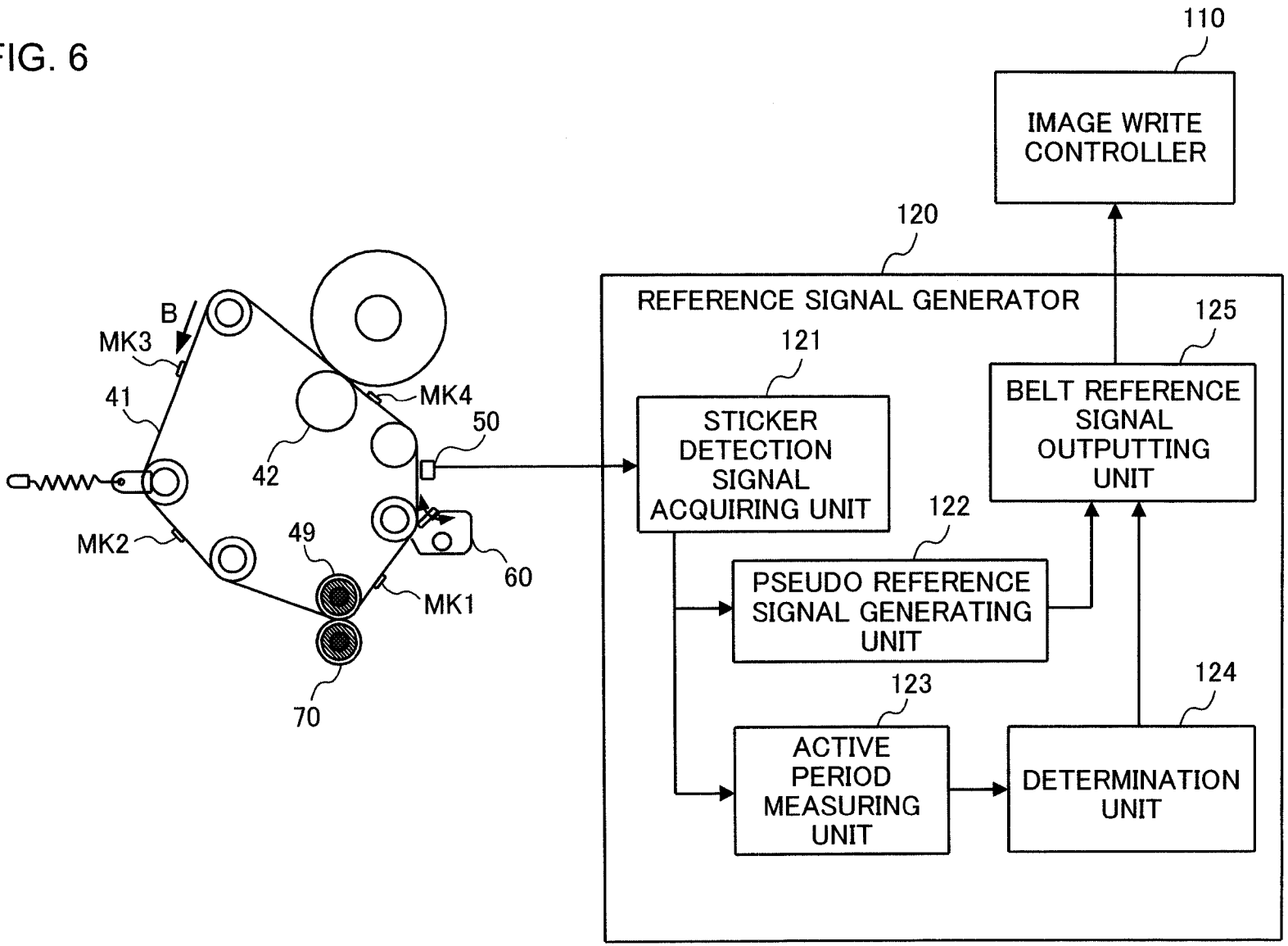
FIG. 6 is a diagram showing a configuration of the reference signal generator.

FIG. 6 is a diagram showing a configuration of the reference signal generator 120. As shown in FIG. 6, the reference signal generator 120 includes: a sticker detection signal acquiring unit 121 as an example of an acquiring unit that acquires the sticker detection signal ((i) in FIG. 5) from the sticker detection unit 50; and a pseudo reference signal generating unit 122 that sets the first mask period and the second mask period on the basis of the sticker detection signal acquired by the sticker detection signal acquiring unit 121, and that generates the pseudo reference signal ((v) in FIG. 5) according to the sticker detection signal, the first mask period and the second mask period. Additionally, the reference signal generator 120 includes: an active period measuring unit 123 that measures the length of the active period of the sticker detection signal; a determination unit 124 that determines whether or not the active period measured by the active period measuring unit 123 is longer than the time period set in advance (the active set time period); and a belt reference signal outputting unit 125.

The belt reference signal outputting unit 125 outputs the belt reference signal TRO ((vi) in FIG. 5) to the image write controller 110, in synchronization with the pseudo reference signal ((v) in FIG. 5) generated by the pseudo reference signal generating unit 122, if it is determined by the determination unit 124 that the measured active period is longer than the active set time period.

<Description of Case where Pseudo Reference Signal is not Outputted as Belt Reference Signal>

Figure 7:
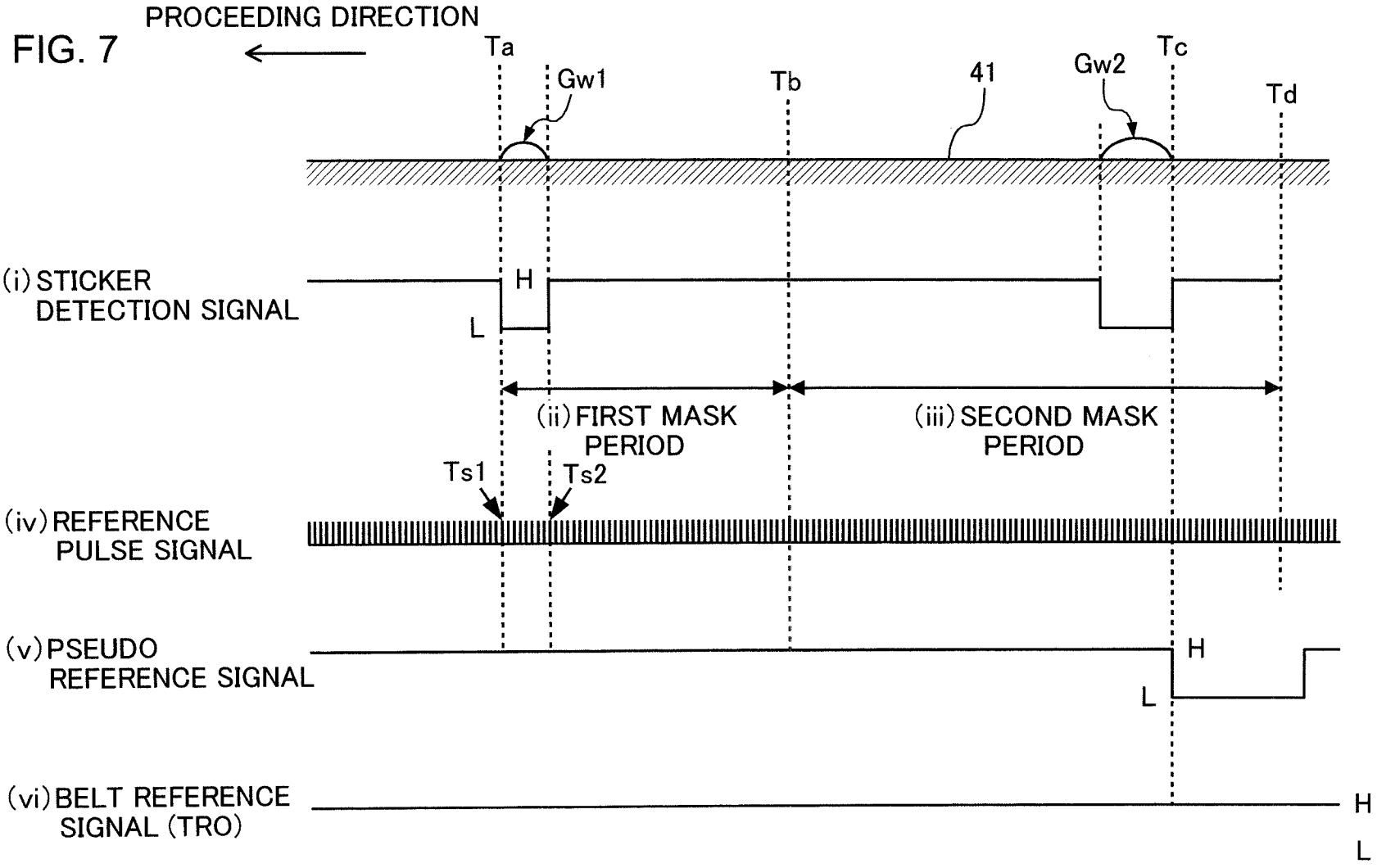
FIG. 7 is a diagram illustrating a case where the belt reference signal outputting unit does not output the pseudo reference signal generated by the pseudo reference signal generating unit as the belt reference signal, to the image write controller.

FIG. 7 is a diagram illustrating a case where the belt reference signal outputting unit 125 does not output the pseudo reference signal generated by the pseudo reference signal generating unit 122 as the belt reference signal TRO, to the image write controller 110, if it is determined by the determination unit 124 that the measured active period is shorter than the active set time period.

As described above, the sticker detection unit 50 outputs the sticker detection signal on the basis of the difference in light reflectivity between the surface of the intermediate transfer belt 41 and the sticker for position detection MK. Thus, the sticker detection unit 50 may also output the sticker detection signal when, for example, adhesion materials Gw1 and Gw2, such as dirt or toner, having higher reflectivity than the surface of the intermediate transfer belt 41 adhere to the surface of the intermediate transfer belt 41. For example, as shown in (i) in FIG. 7, the signal level of the sticker detection signal outputted from the sticker detection unit 50 is changed from "H" to "L" (asserted) by detection of the adhesion material Gw1, and is then changed from "L" to "H" (negated).

For this reason, the pseudo reference signal generating unit 122 sets the first mask period ((ii) in FIG. 7) at the time point (Ta) when the signal level of the sticker detection signal from the sticker detection unit 50 is changed from "H" to "L" (asserted), and further sets the second mask period ((iii) in FIG. 7) from the time point Tb when the first mask period ends, similarly to the case where the sticker for position detection MK is detected. Since, in the second mask period ((iii) in FIG. 7), the pseudo reference signal generating unit 122 regards only a change in the signal level from "L" to "H" (a negation) detected for the first time after the start of the second mask period as valid, the pseudo reference signal generating unit 122 generates the pseudo reference signal ((v) in FIG. 7) at the time point (Tc) when the signal level changes from "L" to "H" (makes the second change) for the first time because of the other adhesion material Gw2 located on the downstream side of the adhesion material Gw1, for example. However, this pseudo reference signal is caused by the adhesion materials Gw1 and Gw2, not by detection of the sticker for position detection MK.

Most of the adhesion materials Gw1 and Gw2 adhering to the surface of the intermediate transfer belt 41, deposits depositing in a joint part of a film (Film) to be described later, and the like usually have smaller areas, as compared with the sticker for position detection MK. Thus, the active period of the sticker detection signal caused by the adhesion materials Gw1 and Gw2 and the like is shorter than that of the sticker detection signal caused by the sticker for position detection MK. For this reason, if the first time length forming the first mask period is set to a time length that is shorter than the time period required for the sticker for position detection MK to pass the sticker detection unit 50 and that is approximated to this required time period, and if the active period of the sticker detection signal is shorter than the above first mask period (first time length), then it may be judged that the sticker detection signal is the one caused by the adhesion materials Gw1 and Gw2 and the like other than the sticker for position detection MK. On the other hand, if the measured active period of the sticker detection signal is longer than the first mask period (first time length), then it may be judged that the sticker detection signal is the one caused by the sticker for position detection MK.

Accordingly, in the reference signal generator 120 according to the present exemplary embodiment, the active period measuring unit 123 measures the length of the active period of the sticker detection signal outputted from the sticker detection unit 50. Then, the determination unit 124 determines whether the measured active period is longer than the time period set in advance (the active set time period), which is shorter than the first time length forming the first mask period, or the measured active period is shorter than the active set time period. As a result of the determination, if the measured active period is shorter than the active set time period, it is judged that the pseudo reference signal generated by the pseudo reference signal generating unit 122 is caused by adhesion materials and the like other than the sticker for position detection MK. Thus, as shown in (vi) in FIG. 7, the reference signal generator 120 does not output the belt reference signal TRO to the image write controller 110. That is, the belt reference signal outputting unit 125 does not cause the signal level of the belt reference signal TRO, which is to be outputted to the image write controller 110, to change from "H" to "L" (be asserted), in synchronization with an assertion of the pseudo reference signal.

In contrast, if the measured active period is longer than the active set time period, it may be judged that the pseudo reference signal generated by the pseudo reference signal generating unit 122 is caused by the sticker for position detection MK. Thus, as shown in (vi) in FIG. 5, the reference signal generator 120 outputs the belt reference signal TRO to the image write controller 110. That is, the belt reference signal outputting unit 125 causes the signal level of the belt reference signal TRO, which is to be outputted to the image write controller 110, to change from "H" to "L" (be asserted), in synchronization with an assertion of the pseudo reference signal.

As described above, in the reference signal generator 120 according to the present exemplary embodiment, the length of the active period of the sticker detection signal outputted from the sticker detection unit 50 is measured. Then, if the measured active period is longer than the time period set in advance (the active set time period), which is shorter than the first mask period (first time length), the belt reference signal TRO is outputted to the image write controller 110. Thereby, output of the belt reference signal TRO because of adhesion materials and the like other than the sticker for position detection MK is prevented, and color toner images are prevented from being transferred onto the intermediate transfer belt 41 with different positions in the second scanning direction as a reference.

<Description of Generation of Belt Reference Signal>

Figures 1, 8:
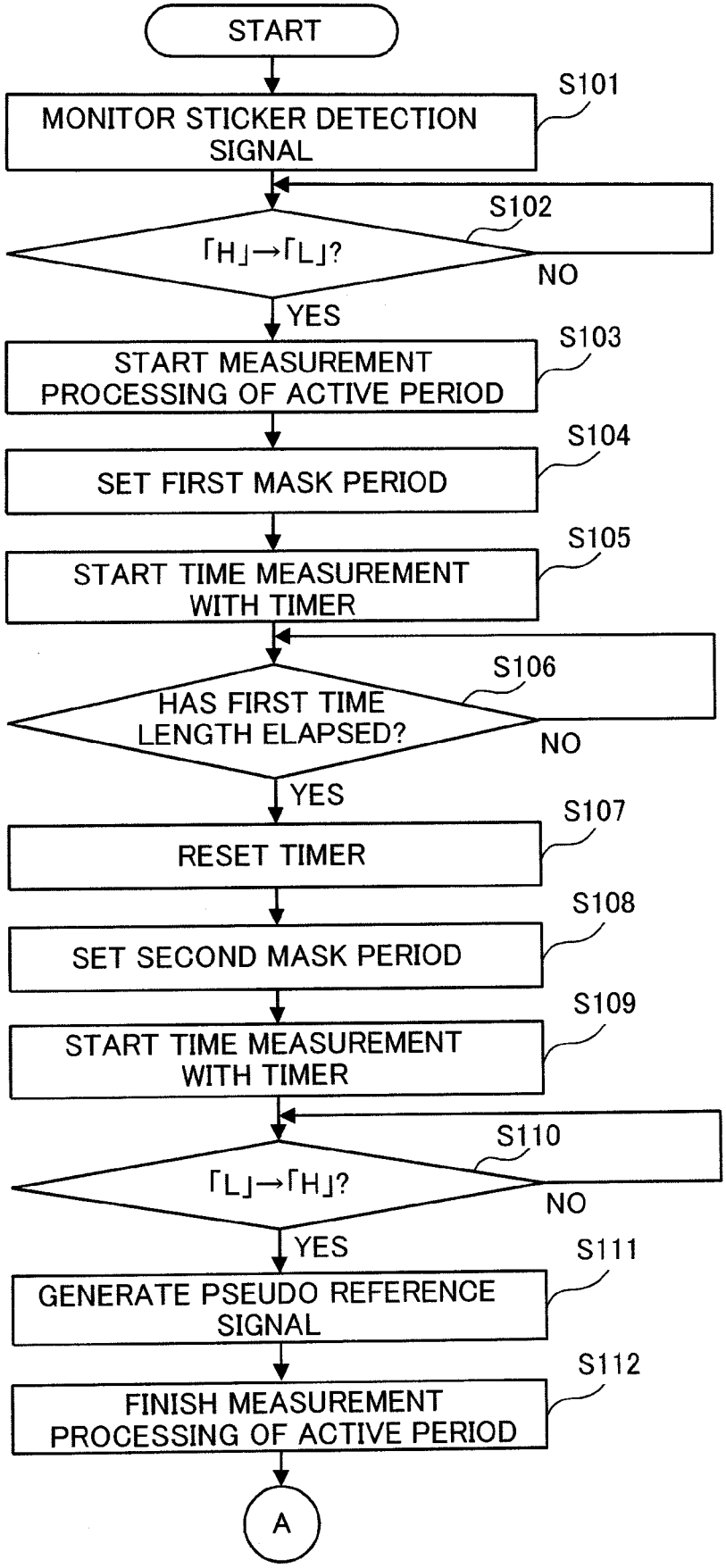
Figures 2, 8:
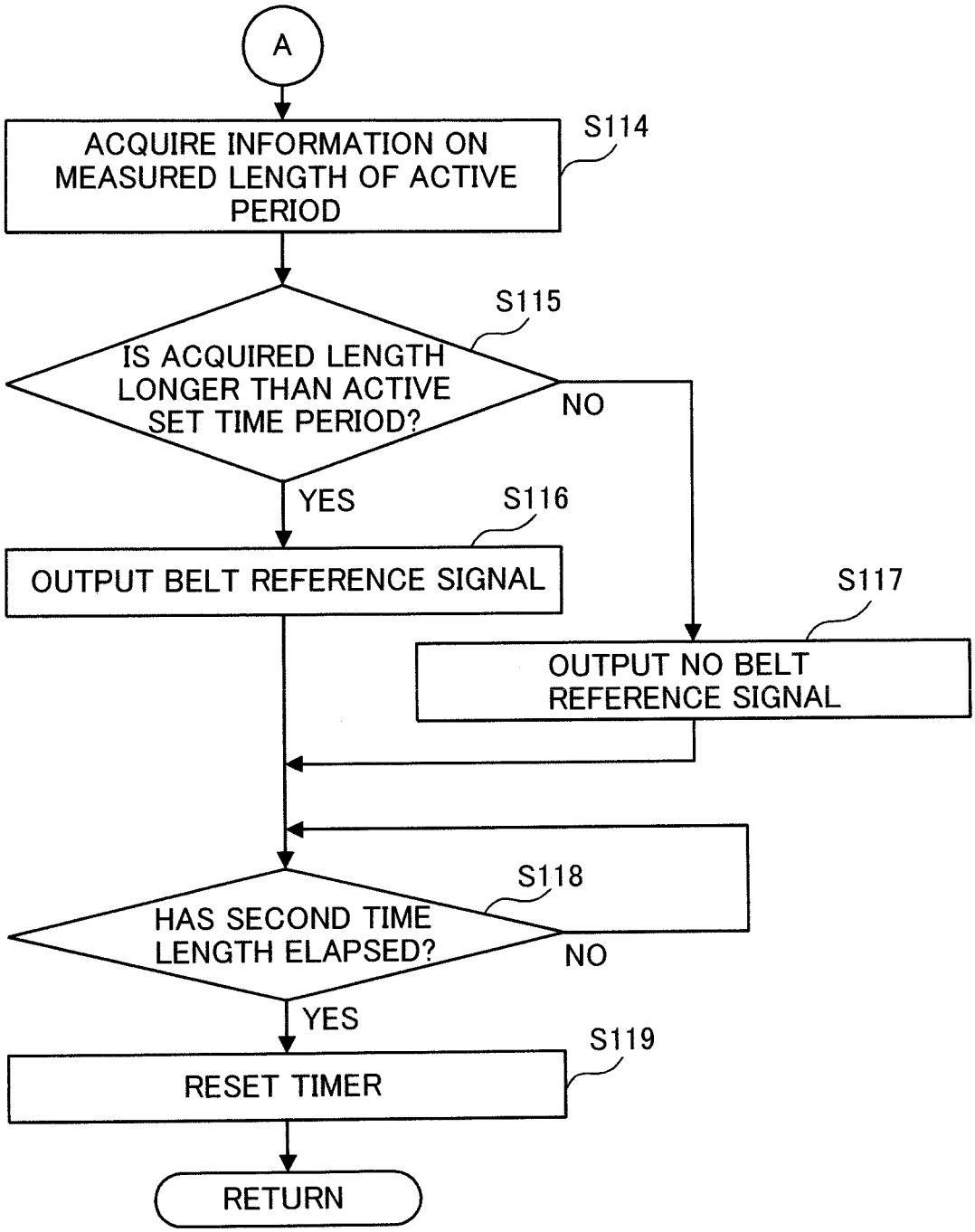

Next, FIGS. 8-1 and 8-2 are flowcharts showing a procedure of processing when the reference signal generator 120 generates the belt reference signal TRO.

First, as shown in FIG. 8-1, the reference signal generator 120 monitors the sticker detection signal outputted from the sticker detection unit 50 (Step 101). When the sticker detection signal outputted from the sticker detection unit 50 changes from the high level ("H") to the low level ("L") (Yes in Step 102), the reference signal generator 120 starts measurement processing of the active period of the signal (Step 103), and sets the first mask period having the predetermined first time length (Step 104). On the other hand, while the sticker detection signal maintains "H" (No in Step 102), the reference signal generator 120 does not set the first mask period.

On setting the first mask period, the reference signal generator 120 starts time measurement with a timer (Step 105) and monitors elapsing of the first time length (No in Step 106). The reference signal generator 120 ignores a change in the signal (change in the signal level between "H" and "L") until the first time length of the first mask period elapses. Even if there is a change in the signal, the reference signal generator 120 regards the change as invalid.

Then, when the first time length has elapsed (Yes in Step 106), the reference signal generator 120 resets the timer (Step 107) and sets the second mask period having the predetermined second time length (Step 108).

On setting the second mask period, the reference signal generator 120 starts time measurement with the timer (Step 109) and monitors a change in the signal level of the signal from "L" to "H" (No in Step 110). When the signal level of the signal changes from "L" to "H" (Yes in Step 110), the reference signal generator 120 generates the pseudo reference signal (Step 111). Furthermore, the reference signal generator 120 finishes the measurement processing of the active period of the signal (Step 112).

Subsequently, with reference to FIG. 8-2, the reference signal generator 120 acquires information on the measured length of the active period (Step 114), and determines whether the acquired length of the active period is longer than the active set time period, or shorter than the active set time period (Step 115).

If the length of the active period is longer than the active set time period (Yes in Step 115), the reference signal generator 120 outputs the belt reference signal TRO to the image write controller 110, in synchronization with an assertion of the generated pseudo reference signal (Step 116). On the other hand, if the length of the active period is shorter than the active set time period (No in Step 115), the reference signal generator 120 does not output the belt reference signal TRO to the image write controller 110 (Step 117).

After that, the reference signal generator 120 monitors elapsing of the second time length (No in Step 118). The reference signal generator 120 ignores a change in the sticker detection signal in the period until the second time length elapses. Even if there is a change in the sticker detection signal, the reference signal generator 120 regards the change as invalid. Then, when the second time length has elapsed (Yes in Step 118), the reference signal generator 120 resets the timer (Step 119) and starts the generation processing for the belt reference signal TRO in the next image forming cycle.

<Description of Internal Configuration of Reference Signal Generator>

Figure 9:
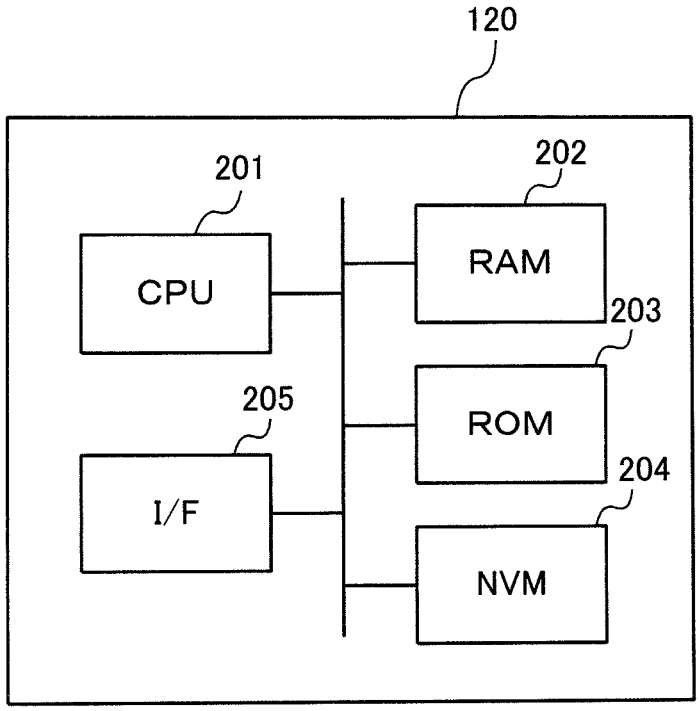
FIG. 9 is a block diagram showing an internal configuration of the reference signal generator.

Next, FIG. 9 is a block diagram showing an internal configuration of the reference signal generator 120. As shown in FIG. 9, the reference signal generator 120 includes a CPU 201, a RAM 202, a ROM 203, a non-volatile memory (NVM) 204 and an interface (I/F) 205. The CPU 201 executes digital calculation processing in accordance with a predetermined processing program, for executing the generation processing of the belt reference signal TRO described above. The RAM 202 is used as a working memory or the like for the CPU 201. The ROM 203 stores therein various setting values (for example, data on the first time length and the second time length and data on the active set time period) used in the processing in the CPU 201. The NVM 204, such as a flash memory, is a rewritable, holds data even in a case where the power supply is stopped, and is backed up by a battery. The I/F 205 controls input and output of signals with each of the units, such as the sticker detection unit 50, the image write controller 110, an external memory (not shown) and the like.

The CPU 201 reads the processing program from the external memory and loads it into a main memory (the RAM 202), and executes the generation processing of the belt reference signal TRO.

Note that, as another provision method on this processing program, the program may be provided while being prestored in the ROM 203, and be loaded into the RAM 202. In addition, when an apparatus is provided with a rewritable ROM 203 such as an EEPROM, only this program may be installed in the ROM 203 after the CPU 201 is set, and then may be loaded into the RAM 202. Moreover, this program may also be transmitted to the reference signal generator 120 through a network such as the Internet, and then installed in the ROM 203 of the reference signal generator 120, and further loaded into the RAM 202. In addition, the program may be loaded into the RAM 202 from an external recording medium such as a DVD-ROM, a flash memory or the like.

<Description of Circuit Configuration of Sticker Detection Unit>

Next, a configuration of the sticker detection unit 50 will be described.

Figure 10A:
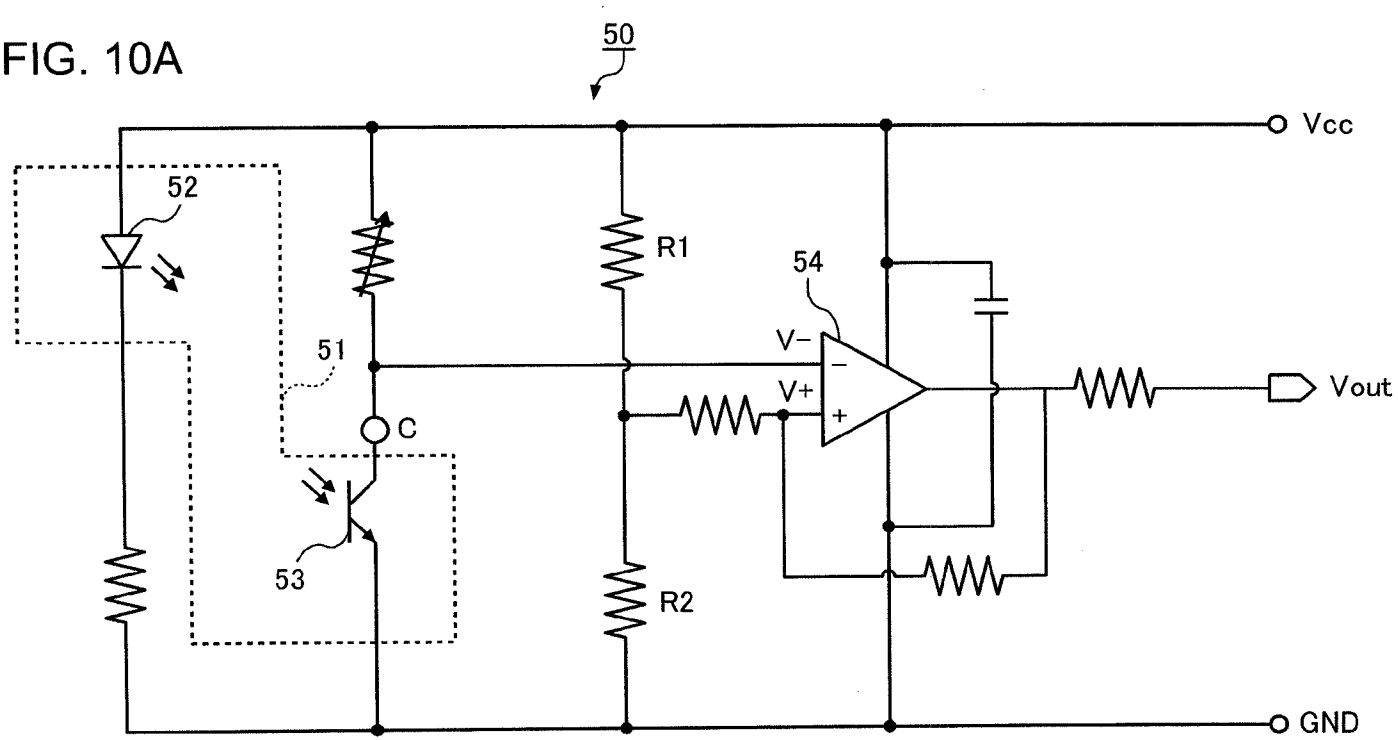
FIGS. 10A and 10B are circuit diagrams showing the configuration of the sticker detection unit outputting the sticker detection signal.
Figure 10B:
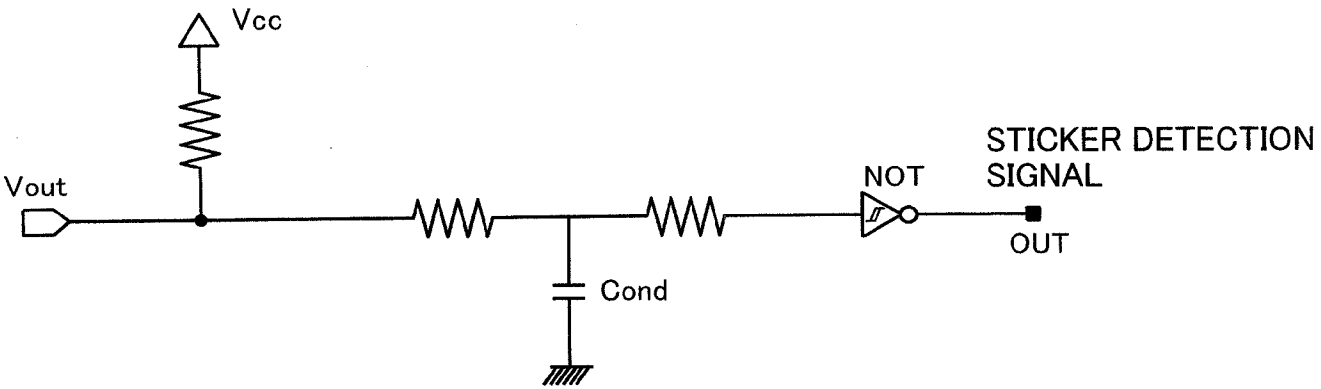

FIGS. 10A and 10B are circuit diagrams showing the configuration of the sticker detection unit 50 outputting the sticker detection signal. In a precedent stage circuit shown in FIG. 10A, as a sensor unit 51 arranged so as to face the sticker for position detection MK on the intermediate transfer belt 41, the sticker detection unit 50 includes: a light-emitting diode (LED) 52 that is lighted up by a power supply voltage Vcc and emits light toward the sticker for position detection MK on the intermediate transfer belt 41; and a light sensor 53 that is connected by employing an open collector type and receives the light having been emitted from the LED 52 and reflected by the sticker for position detection MK. The light sensor 53 has an output terminal (C) pulled up by the power supply voltage Vcc, and the output terminal (C) is connected to a V− side, which is one input terminal of a comparator 54. Additionally, a comparison voltage for comparison with the output voltage from the light sensor 53 is inputted to a V+ side, which is the other input terminal of the comparator 54. This comparison voltage is set to be smaller than the power supply voltage Vcc by dividing the power supply voltage Vcc with resistances R1 and R2.

The light sensor 53 of the sensor unit 51 is turned on by detecting the reflected light from the sticker for position detection MK, and the output terminal (C) thereof is set at a ground potential GND. Meanwhile, the light sensor 53 of the sensor unit 51 is turned off in a state where the reflected light from the sticker for position detection MK is not incident thereon, and the output terminal (C) thereof is set at the power supply voltage Vcc. With this configuration, an output terminal Vout of the comparator 54 outputs an output signal having a signal level "L" when the reflected light from the sticker for position detection MK is not incident on the light sensor 53, and outputs an output signal having a signal level "H" when the light sensor 53 detects the reflected light from the sticker for position detection MK.

Then, the output terminal Vout of the comparator 54 is connected with a subsequent stage circuit shown in FIG. 10B, and outputs an output signal having the signal level "L" or "H" to the subsequent stage circuit in accordance with the output voltage from the light sensor 53.

In the subsequent stage circuit shown in FIG. 10B, in order to remove chattering generated in the output signal from the output terminal Vout of the precedent stage circuit shown in FIG. 10A, the output signal from the output terminal Vout is inputted to a Schmitt trigger (NOT) through a grounded capacitor Cond, and is then outputted from an output terminal OUT as the sticker detection signal.

With this configuration, the sticker detection signal outputted from the output terminal OUT in the signal output circuit according to the present exemplary embodiment is generated so as to be a signal having a short variation range in the signal level from "H" to "L" and "L" to "H" at the front end portion (MK_a) and the rear end portion (MK_b) of the sticker for position detection MK, respectively, as shown in (i) in FIG. 5.

Note that the part of the circuit other than the sensor unit 51 shown in FIGS. 10A and 10B may be configured integrally with the sensor unit 51, or separately from the sensor unit 51. If configured separately, the configuration may be such that only the sensor unit 51 is arranged at the position facing the stickers for position detection MK1 to MK4 on the intermediate transfer belt 41, and the part of the circuit other than the sensor unit 51 is arranged in a region different from that of the sensor unit 51.

<Description of Action by Generation Processing of Belt Reference Signal in Reference Signal Generator>

Next, a description will be given of action caused by the reference signal generator 120 according to the present exemplary embodiment performing the generation processing about the belt reference signal TRO described above.

Figure 11:
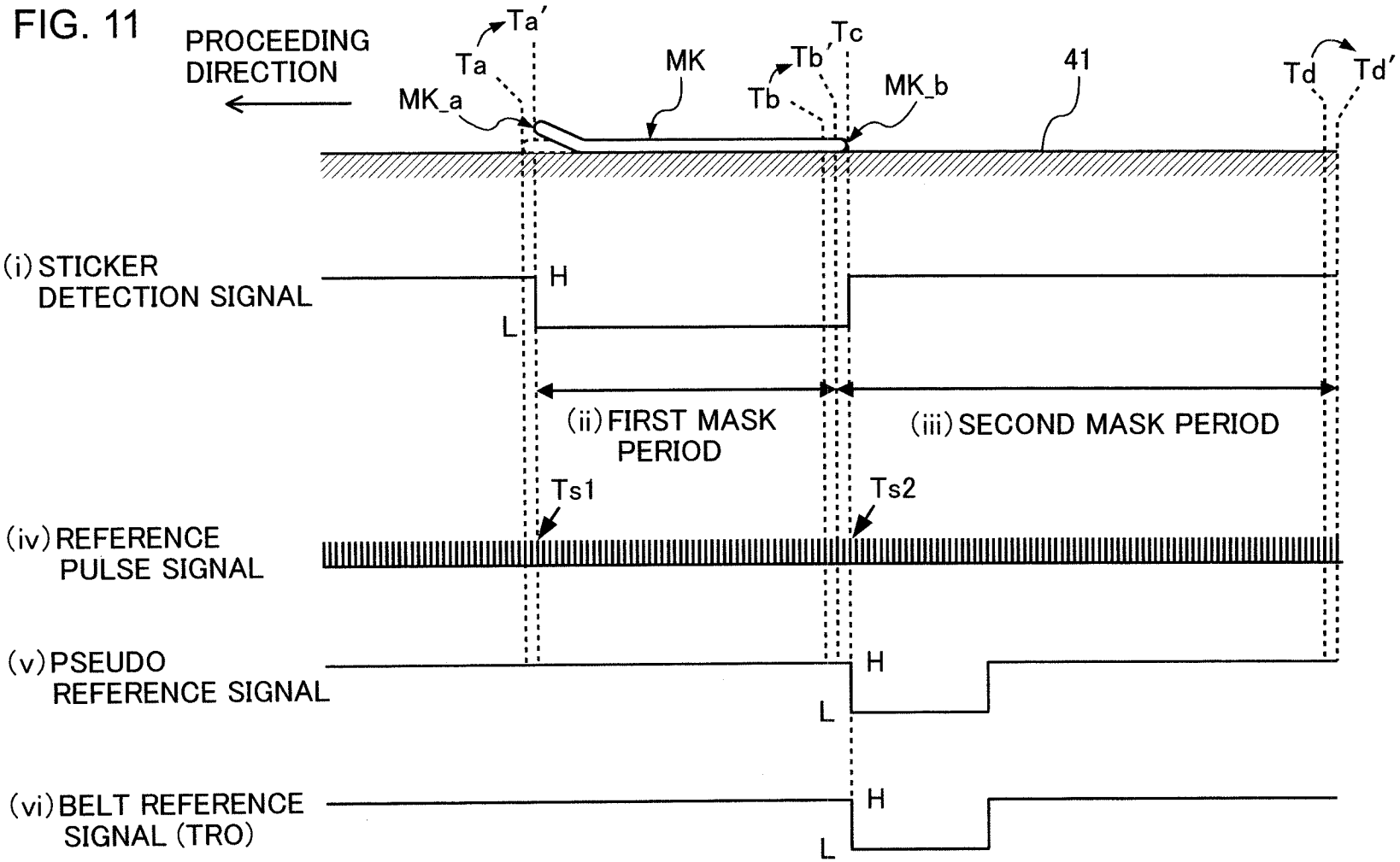
FIG. 11 is a diagram showing a first specific example of the action caused by the generation processing of the belt reference signal in the reference signal generator.

FIG. 11 is a diagram showing a first specific example of the action caused by the generation processing of the belt reference signal TRO in the reference signal generator 120.

FIG. 11 shows a case where the belt cleaner 60 (see FIG. 1) removing the transfer residual toner on the intermediate transfer belt 41 after the toner images are secondarily transferred comes into contact with the sticker for position detection MK, and thereby the front end portion (MK_a) of the sticker for position detection MK is peeled off. In the state shown in FIG. 11, due to peeling of the front end portion (MK_a) of the sticker for position detection MK, the front end portion (MK_a) is positioned farther on the downstream side in the proceeding direction of the intermediate transfer belt 41 than in a normal state (a broken line: see also FIG. 5). Thereby, a time point (Ta') at which the sticker detection signal ((i) in FIG. 11) changes from the high level ("H") to the low level ("L") is delayed as compared with the time point (Ta) at which the change from "H" to "L" occurs in the normal state. In addition, since the front end portion (MK_a) of the sticker for position detection MK is not fixed due to peeling, the time point (Ta') at which the change from "H" to "L" occurs is not stable. Thus, on the occasion of generating the belt reference signal TRO with the front end portion (MK_a) of the sticker for position detection MK as a reference, the output timing of the image data for writing in the second scanning direction is shifted for each color, which may lead to color misregistration in a color image.

In contrast, in the generation processing about the belt reference signal TRO performed by the reference signal generator 120 according to the present exemplary embodiment, the pseudo reference signal ((v) in FIG. 11) is generated on the basis of the rear end portion (MK_b) of the sticker for position detection MK, and the belt reference signal TRO ((vi) in FIG. 11) is outputted to the image write controller 110. That is, since it is unlikely that the rear end portion (MK_b) of the sticker for position detection MK is peeled off due to contact with the belt cleaner 60, the pseudo reference signal ((v) in FIG. 11) is generated on the basis of the rear end portion (MK_b) of the sticker for position detection MK whose position is hardly changed even when coming into contact with the belt cleaner 60. For this reason, even when the front end portion (MK_a) of the sticker for position detection MK is peeled off, the shift in the output timing of the image data for writing in the second scanning direction for each color is reduced.

Additionally, in order to surely detect the rear end portion (MK_b) of the sticker for position detection MK whose front end portion (MK_a) is peeled off as described above, in the present exemplary embodiment, the amount of peeling supposed to occur at the front end portion (MK_a) of the sticker for position detection MK is obtained in advance by an experiment or the like, and the first time length of the first mask period (Tb'−Ta' (=Tb−Ta)) is set on the basis of the supposed amount of peeling.

Specifically, the first time length that is shorter than the time period required for the sticker for position detection MK to pass the sticker detection unit 50 by an amount more than the supposed amount of peeling based on an experiment or the like is set as the first mask period. For this reason, even when the front end portion (MK_a) of the sticker for position detection MK is peeled off, the time point Tb' at which the first mask period ends is set to a time point earlier than the time point Tc at which the rear end portion (MK_b) of the sticker for position detection MK passes the sticker detection unit 50. Thus, the second mask period in which the pseudo reference signal ((v) in FIG. 11) is generated at the time point (Tc) when the sticker detection signal changes from "L" to "H" for the first time is started from a time point earlier than the time point Tc at which the rear end portion (MK_b) of the sticker for position detection MK passes the sticker detection unit 50. Accordingly, the rear end portion (MK_®b) of the sticker for position detection MK is surely detected.

Additionally, the active set time period used when the length of the active period is determined is set to a time length shorter than the first time length, which is shorter than the time period required for the sticker for position detection MK to pass the sticker detection unit 50 by an amount more than the supposed amount of peeling, in consideration of occurrence of peeling at the front end portion (MK_a) of the sticker for position detection MK. Accordingly, it will be determined that the active period of the sticker detection signal according to detection of the sticker for position detection MK whose front end portion (MK_a) is peeled off satisfies the condition that the active period is longer than the active set time period. Thus, the belt reference signal TRO ((vi) in FIG. 11) is surely outputted.

As described above, the reference signal generator 120 according to the present exemplary embodiment generates the pseudo reference signal ((v) in FIG. 11) on the basis of the rear end portion (MK_b) of the sticker for position detection MK whose position is hardly changed even when coming into contact with the belt cleaner 60. For this reason, even when the front end portion (MK_a) of the sticker for position detection MK is peeled off, the shift in the output timing of the image data for writing in the second scanning direction for each color is reduced.

Additionally, the first time length forming the first mask period and the active set time period used when the length of the active period is determined are set by taking into account the amount of peeling supposed to occur at the front end portion (MK_a) of the sticker for position detection MK. Accordingly, the rear end portion (MK_b) of the sticker for position detection MK is surely detected, even when the front end portion (MK_a) of the sticker for position detection MK is peeled off as described above.

Figure 12:
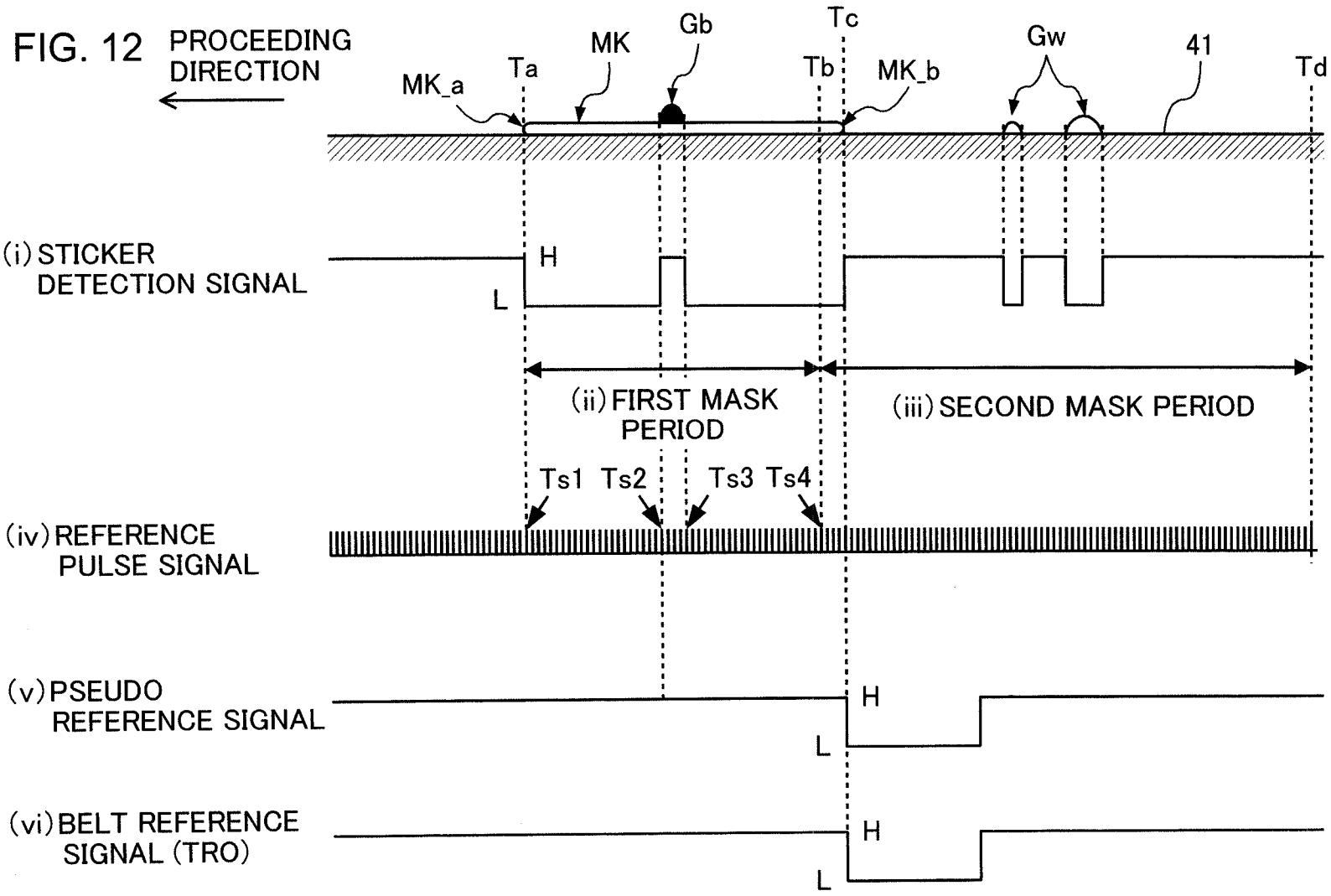
FIG. 12 is a diagram showing a second specific example of the action caused by the generation processing of the belt reference signal in the reference signal generator.

FIG. 12 is a diagram showing a second specific example of the action caused by the generation processing of the belt reference signal TRO in the reference signal generator 120.

FIG. 12 shows a case where, for example, adhesion materials Gb, such as dirt or toner, having lower reflectivity than the sticker for position detection MK adhere to the sticker for position detection MK, and adhesion materials Gw, such as dirt or toner, having higher reflectivity than the surface of the intermediate transfer belt 41 adhere to the region on the intermediate transfer belt 41 other than the sticker for position detection MK. In the state shown in FIG. 12, because of the adhesion materials Gb on the sticker for position detection MK, the sticker detection signal ((i) in FIG. 12) changes from the low level ("L") to the high level ("H"). Additionally, because of the adhesion materials Gw on the intermediate transfer belt 41, the sticker detection signal ((i) in FIG. 12) changes from "H" to "L."

However, as described above, in the generation processing about the belt reference signal TRO performed by the reference signal generator 120 according to the present exemplary embodiment, a change in the sticker detection signal in the first mask period is regarded as invalid. Additionally, in the second mask period, only a change from "L" to "H" detected for the first time after the start of the second mask period is regarded as valid, and the subsequent changes in the sticker detection signal are regarded as invalid. Thus, even if either or both of the adhesion materials Gb on the sticker for position detection MK and the adhesion materials Gw on the intermediate transfer belt 41 exist, detecting the front end portion (MK_a) of the sticker for position detection MK sets the first mask period, and sets the subsequent second mask period, without being affected by these adhesion materials. Accordingly, the rear end portion (MK_b) of the sticker for position detection MK is surely detected, and the pseudo reference signal TRO ((v) in FIG. 12) is stably generated on the basis of the rear end portion (MK_b) of the sticker for position detection MK. Then, the belt reference signal TRO ((vi) in FIG. 12) is stably generated.

In this case, for example, the active period of the sticker detection signal may be measured as a period (the total time period of "Ts2−Ts1" and "Ts4−Ts3") corresponding to a region other than the regions to which the adhesion materials Gb adhere. Thereby, it will be determined that the length of the active period is longer than the active set time period set in advance, because the reduced amount of the active period caused by the regions to which the adhesion materials Gb adhere is small. Accordingly, the belt reference signal TRO ((vi) in FIG. 12) is surely outputted.

As described above, in the reference signal generator 120 according to the present exemplary embodiment, even when either or both of the adhesion materials Gb on the sticker for position detection MK and the adhesion materials Gw on the intermediate transfer belt 41 exist, the shift in the output timing of the image data for writing in the second scanning direction for each color is reduced.

Figure 13A:
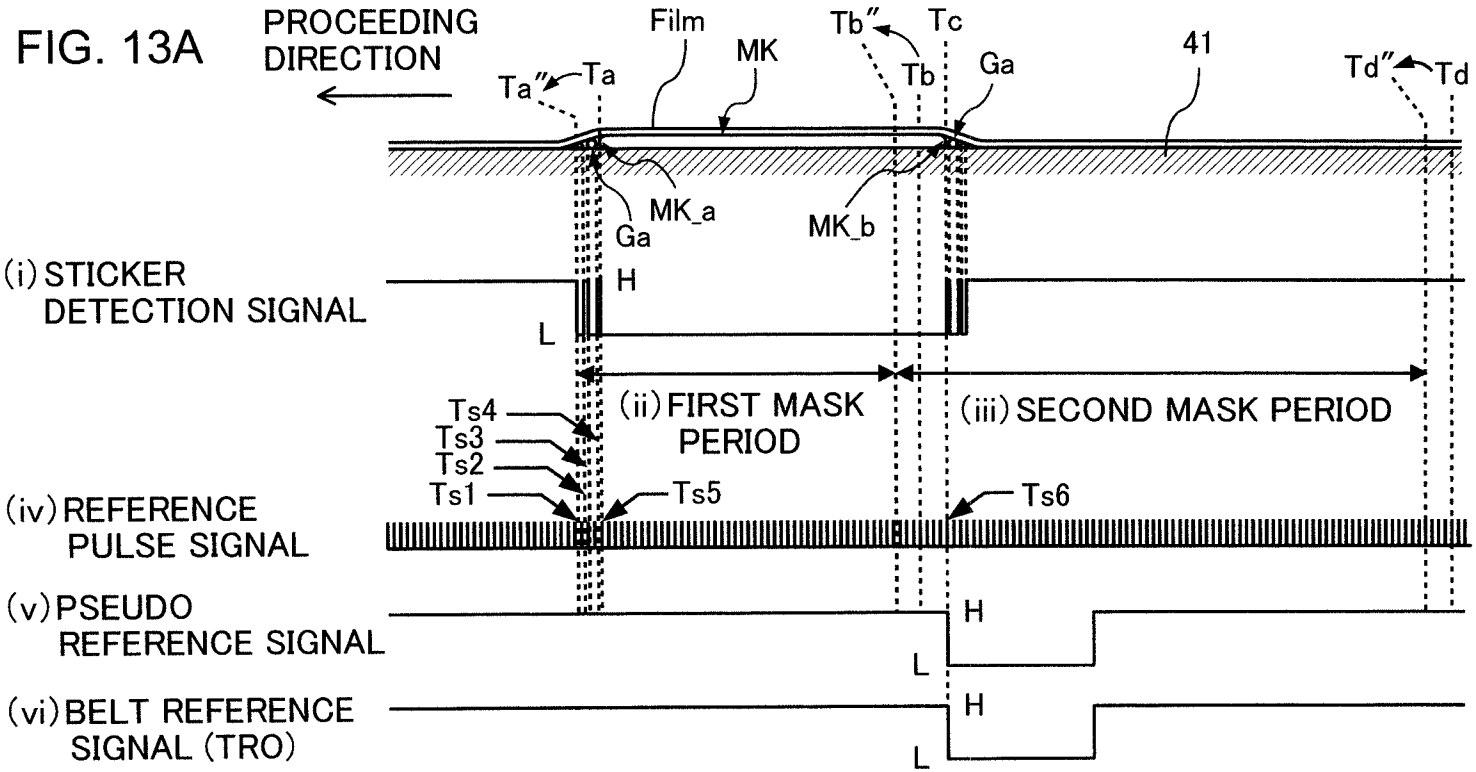
FIGS. 13A and 13B are diagrams showing a third specific example of the action caused by the generation processing of the belt reference signal in the reference signal generator.
Figure 13B:
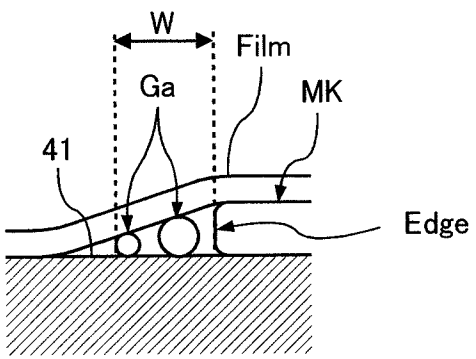

FIGS. 13A and 13B are diagrams showing a third specific example of the action caused by the generation processing of the belt reference signal TRO in the reference signal generator 120.

FIG. 13A shows a case where the arrangement region of the sticker for position detection MK and a periphery region thereof, or a region that is positioned outside of the transfer region Im (see FIG. 2) including the arrangement region of the sticker for position detection MK and that extends the whole circumference in the circumferential direction (the proceeding direction) of the intermediate transfer belt 41 are covered with a thin film (a covering film: Film). Such a configuration prevents peeling of the front end portion (MK_a) of the sticker for position detection MK due to contact with the belt cleaner 60 (see FIG. 1) shown in FIG. 11 described above.

The stickers for position detection MK may have any one of the following configurations: each of the stickers for position detection MK is covered with a film (Film) for individual covering; and all of the stickers for position detection MK are integrally covered with one film (Film).

However, with the configuration shown in FIG. 13A, around an edge portion (Edge) of the sticker for position detection MK, air bubbles Ga may be formed between the film (Film) and the surface of the intermediate transfer belt 41, as shown in FIG. 13B. In such a case, the signal level of the sticker detection signal ((i) in FIG. 13A) changes due to the air bubbles Ga formed around the front end portion (MK_a) and the rear end portion (MK_b) of the sticker for position detection MK. That is, as shown in FIG. 13A, on the upstream side of the front end portion (MK_a) of the sticker for position detection MK, the sticker detection signal ((i) in FIG. 13A) changes from the high level ("H") to the low level ("L") due to the air bubbles Ga. Thereby, a time point (Ta") at which the sticker detection signal changes from "H" to "L" becomes earlier than the time point (Ta) at which the change from "H" to "L" occurs due to the actual front end portion (MK_a) of the sticker for position detection MK.

In contrast, in the generation processing about the belt reference signal TRO performed by the reference signal generator 120 according to the present exemplary embodiment, the size of a region (W in FIG. 13B: hereinafter, referred to as a "bubble forming region") in which the air bubbles Ga are formed and that is supposed to be generated around the edge portion (Edge) of the sticker for position detection MK is obtained in advance by an experiment or the like, and the first time length of the first mask period (Tb"−Ta" (=Tb−Ta)) is set on the basis of the size of the supposed bubble forming region W. Specifically, the first time length lengthened by the size of the supposed bubble forming region W is set as the first mask period. Thereby, the time point Tb" at which the first mask period ends is set to a time point earlier than the time point Tc at which the rear end portion (MK_b) of the sticker for position detection MK passes the sticker detection unit 50, and the time point Tb" is set so that the time interval between the time points Tb" and Tc are short.

For this reason, even when the bubble forming region W is generated on the front end portion (MK_a) side of the sticker for position detection MK and when the air bubbles Ga cause the sticker detection signal to change from "H" to "L" on the upstream side as compared with the actual front end portion (MK_a), the time point Tb" at which the first mask period ends is set to a time point earlier than the time point Tc at which the rear end portion (MK_b) of the actual sticker for position detection MK passes the sticker detection unit 50. Thus, the second mask period in which the pseudo reference signal ((v) in FIG. 13A) is generated at the time point (Tc) when the sticker detection signal changes from "L" to "H" for the first time is started from a time point earlier than the time point Tc at which the rear end portion (MK_b) of the sticker for position detection MK passes the sticker detection unit 50. Additionally, on the rear end portion (MK_b) side of the sticker for position detection MK, the rear end portion (MK_b) is positioned on the upstream side of the bubble forming region W. Thus, the change in the sticker detection signal from "L" to "H" for the first time after the start of the second mask period is caused by the rear end portion (MK_b). Accordingly, the rear end portion (MK_b) of the sticker for position detection MK is surely detected.

In addition, the time interval between the time point Tb" at which the first mask period ends and the time point Tc at which the rear end portion (MK_b) of the sticker for position detection MK passes the sticker detection unit 50 are set to be short. Thus, the pseudo reference signal ((v) in FIG. 13A) is stably generated on the basis of the rear end portion (MK_b) of the sticker for position detection MK, while reducing influence of adhesion materials, such as dirt or toner, existing on the intermediate transfer belt 41 passing between these time points.

As described above, in the reference signal generator 120 according to the present exemplary embodiment, even when the sticker for position detection MK is configured so as to be covered with the film (Film), the shift in the output timing of the image data for writing in the second scanning direction for each color is reduced.

Additionally, in this case, the active set time period used when the length of the active period is determined is set to a time length shorter than the first time length, which is longer than the time period required for the sticker for position detection MK to pass the sticker detection unit 50 by an amount corresponding to the size of the supposed bubble forming region W, in consideration of generation of the bubble forming region W on the front end portion (MK_a) side of the sticker for position detection MK. Accordingly, it will be determined that the active period of the sticker detection signal according to detection of the sticker for position detection MK of which the bubble forming region W is generated on the front end portion (MK_a) satisfies the condition that the active period is longer than the active set time period. Thus, the belt reference signal TRO ((vi) in FIG. 13A) is surely outputted.

Furthermore, for example, the active periods of the sticker detection signal including those generated by changes of the signal level in the bubble forming region W (such as "Ts2–Ts1" and "Ts4–Ts3") may be individually measured for each of the active periods, and the longest active period ("Ts6–Ts5") may be used for the determination. The longest active period ("Ts6–Ts5") is the one that is caused by the sticker for position detection MK covered with the film (Film). Accordingly, it will be determined that the length of the active period is longer than the active set time period set in advance, and thus the belt reference signal TRO ((vi) in FIG. 13A) is surely outputted.

Figure 14:
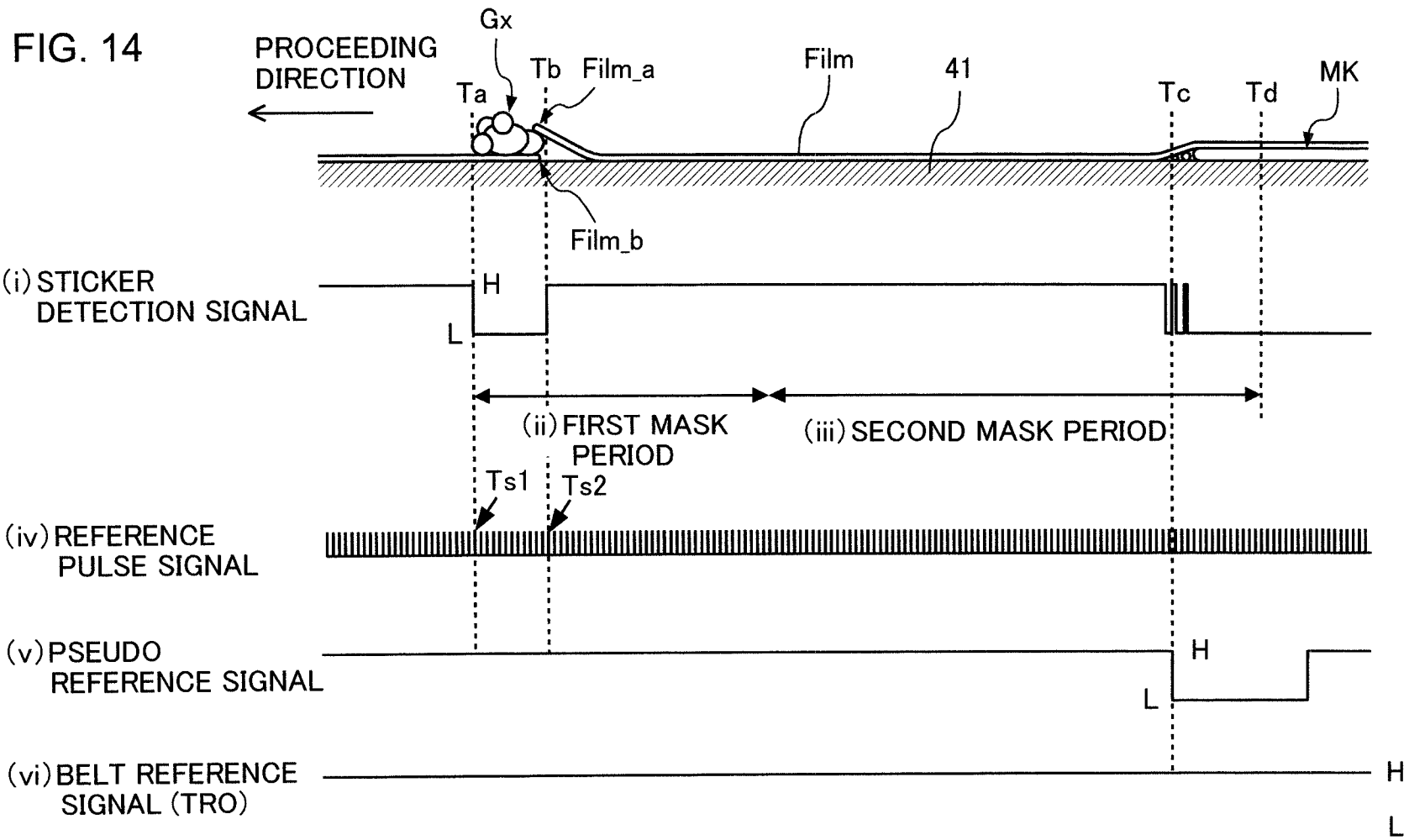
FIG. 14 is a diagram showing a fourth specific example of the action caused by the generation processing of the belt reference signal in the reference signal generator.

FIG. 14 is a diagram showing a fourth specific example of the action caused by the generation processing of the belt reference signal TRO in the reference signal generator 120.

FIG. 14 shows a case where the sticker for position detection MK is covered with the film (Film) and a joint part of the film (Film) is peeled off by contact with the belt cleaner 60, for example, similarly to the configuration shown in FIG. 13A. In such a case, toner and the like, for example, may deposit on the peeled joint part of the film (Film), thereby to generate deposits Gx having higher reflectivity than the surface of the intermediate transfer belt 41.

If a region having higher reflectivity than the surface of the intermediate transfer belt 41, such as the deposits Gx generated on the joint part of the film (Film) shown in FIG. 14, is generated in the region other than the sticker for position detection MK on the intermediate transfer belt 41, the generation processing about the belt reference signal TRO may be started from the region. In such a case, the belt reference signal TRO generated on the basis of the sticker for position detection MK is not outputted, and thus positioning of color toner images is inhibited.

In contrast, in the reference signal generator 120 according to the present exemplary embodiment, the active period measuring unit 123 measures the length of the active period of the sticker detection signal outputted from the sticker detection unit 50. Thus, the sticker detection signal caused by the deposits Gx generated on the joint part of the film (Film) is distinguished from the one that is caused by the sticker for position detection MK, by using the measured length of the active period of the sticker detection signal.

As described above, even for the sticker detection signal ((i) in FIG. 14) caused by the deposits Gx, the first mask period ((ii) in FIG. 14) is set at the time point (Ta) when the signal level of the sticker detection signal from the sticker detection unit 50 is changed from "H" to "L" (asserted), and further the second mask period ((iii) in FIG. 14) is set from the time point when the first mask period ends, similarly to the case where the sticker for position detection MK is detected. Since, in the second mask period ((iii) in FIG. 14), the pseudo reference signal generating unit 122 regards only a change in the signal level from "L" to "H" (a negation) detected for the first time after the start of the second mask period as valid, the pseudo reference signal generating unit 122 generates the pseudo reference signal ((v) in FIG. 14) at the time point (Tc) when the signal level changes from "L" to "H" for the first time because of the front end portion (MK_a) of the sticker for position detection MK located on the downstream side of the deposits Gx at the joint part, for example. However, since this pseudo reference signal is caused by the sticker detection signal of which the length of the active period is shorter than the active set time period, the belt reference signal outputting unit 125 does not cause the signal level of the belt reference signal TRO ((vi) in FIG. 14), which is to be outputted to the image write controller 110, to change from "H" to "L" (be asserted), in synchronization with an assertion of the pseudo reference signal. Accordingly, the belt reference signal TRO based on the sticker detection signal caused by something other than the sticker for position detection MK is not outputted.

As described above, if the generation processing about the belt reference signal TRO is started by the sticker detection signal caused by something other than the sticker for position detection MK, the reference signal generator 120 according to the present exemplary embodiment does not output the belt reference signal TRO. Thereby, only the belt reference signal TRO based on the sticker detection signal caused by the sticker for position detection MK is generated, and thus the shift in the output timing of the image data for writing in the second scanning direction for each color is reduced.

As has been described above, in the image forming apparatus 1 according to the present exemplary embodiment, the reference signal generator 120 sets the first mask period at the time point when the sticker detection unit 50 detects the front end portion (MK_a) of one of the stickers for position detection MK1 to MK4, and when the sticker detection signal changes from the high level ("H") to the low level ("L"). In this first mask period, a change in the sticker detection signal is ignored. Even if there is a change in the sticker detection signal, this change is regarded as invalid. Subsequently, the second mask period is set from the time point Tb at which the first mask period ends. In this second mask period, only a change in the signal level from "L" to "H" detected for the first time after the start of the second mask period is regarded as valid, and the subsequent changes in the sticker detection signal are ignored. Even if there is a change in the sticker detection signal, this change is regarded as invalid. On this occasion, the length of the active period of the sticker detection signal outputted from the sticker detection unit 50 is measured. If the measured active period is longer than the time period set in advance (the active set time period), the reference signal generator 120 outputs the belt reference signal TRO to the image write controller 110 at the time point when the change from "L" to "H" is detected for the first time after the start of the second mask period.

Thereby, even when the front end portion (MK_a) of the sticker for position detection MK is peeled off, when either or both of the adhesion materials on the sticker for position detection MK and the adhesion materials on the intermediate transfer belt 41 exist, and further, when the sticker for position detection MK is configured so as to be covered with the film (Film), the shift in the output timing of the image data for writing in the second scanning direction for each color is reduced, and thereby, accuracy for positioning color toner images is improved.

Additionally, output of the belt reference signal TRO because of adhesion materials and the like other than the sticker for position detection MK is prevented, and color toner images are prevented from being transferred onto the intermediate transfer belt 41 with different positions in the second scanning direction as a reference.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image forming unit that emits light in accordance with image data on receiving input of the image data, and that scans and exposes an image carrier with the light, to form a latent image on the image carrier;

a transfer body on which a toner image is transferred and a reference index is formed, the toner image being formed by developing the latent image on the image carrier, the reference index serving as a reference for setting an output start time point from which the image data is outputted to the latent image forming unit;

a detecting unit that is arranged so as to face the reference index formed on the transfer body, and that outputs a detection signal changing in accordance with passing of the reference index;

a measuring unit that measures change duration time from a first change occurring in the detection signal outputted from the detecting unit to a second change occurring after the first change; and a controller that controls, by using the detection signal outputted from the detecting unit, the output start time point of the image data to the latent image forming unit, wherein the controller starts, concurrently with the first change occurring in the detection signal, a first period having a first time length during which changes occurring in the detection signal are ignored, starts, after an elapsing of the first period, a second period having a second time length, regards an initial change of the detection signal subsequent to the start of the second period as the reference of the output start time point of the image data, if the change duration time measured by the measuring unit is longer than a predetermined time period, and ignores changes of the detection signal after the initial change of the detection signal subsequent to the start of the second period occurs.

2. The image forming apparatus according to claim 1, wherein the controller regards the initial change of the detection signal subsequent to the start of the second period as the reference of the output start time point of the image data, if the change duration time measured by the measuring unit is longer than the predetermined time period that is shorter than the first time length.

3. The image forming apparatus according to claim 1, wherein the transfer body has a plurality of the reference indices formed on the transfer body along a proceeding direction of the transfer body, and has any one of configurations: each of the plurality of reference indices is individually covered with a covering film, and all of the plurality of reference indices are integrally covered with a covering film, and the controller sets the first time length of the first period shorter than a time period that is required from a start of the first period to an arrival of a rear end portion of the reference indices covered with the covering film to an arrangement position of the detecting unit, and regards the initial change of the detection signal subsequent to the start of the second period as the reference of the output start time point of the image data, if the change duration time measured by the measuring unit is longer than the predetermined time period that is shorter than the first time length.

4. A control device comprising:

an acquiring unit acquiring a detection signal from a detecting unit that is arranged so as to face a reference index formed on a transfer body on which a toner image held on an image carrier is transferred, the detecting unit outputting the detection signal changing in accordance with passing of the reference index;

a measuring unit that measures change duration time from a first change occurring in the detection signal acquired by the acquiring unit to a second change occurring after the first change; and a controller that controls an output start time point of image data to a latent image forming unit by using the detection signal acquired by the acquiring unit, the latent image forming unit scanning and exposing the image carrier with light emitted in accordance with the image data, to form a latent image being a source of the toner image on the image carrier, wherein the controller starts, concurrently with the first change occurring in the detection signal, a first period having a first time length during which changes occurring in the detection signal are ignored, starts, after an elapsing of the first period, a second period having a second time length, regards an initial change of the detection signal subsequent to the start of the second period as the reference of the output start time point of the image data, if the change duration time measured by the measuring unit is longer than a predetermined time period, and ignores changes of the detection signal after the initial change of the detection signal subsequent to the start of the second period occurs.

5. The control device according to claim 4, wherein the controller regards the initial change of the detection signal subsequent to the start of the second period as the reference of the output start time point of the image data, if the change duration time measured by the measuring unit is longer than the predetermined time period that is shorter than the first time length.

6. The control device according to claim 4, wherein the transfer body has a plurality of the reference indices formed on the transfer body along a proceeding direction of the transfer body, and has any one of configurations: each of the plurality of reference indices is individually covered with a covering film, and all of the plurality of reference indices are integrally covered with a covering film, and the controller sets the first time length of the first period shorter than a time period that is required from a start of the first period to an arrival of a rear end portion of the reference indices covered with the covering film to an arrangement position of the detecting unit, and regards the initial change of the detection signal subsequent to the start of the second period as the reference of the output start time point of the image data, if the change duration time measured by the measuring unit is longer than the predetermined time period that is shorter than the first time length.

7. A detecting method of a reference index on a transfer body comprising:

acquiring a detection signal from a detecting unit that is arranged so as to face a reference index formed on a transfer body on which a toner image held on an image carrier is transferred, the detecting unit outputting the detection signal changing in accordance with passing of the reference index;

starting, concurrently with a first change occurring in the detection signal thus acquired, a first period having a first time length during which changes occurring in the detection signal are ignored;

measuring change duration time from the first change occurring in the detection signal to a second change occurring after the first change;

starting, after an elapsing of the first period, a second period having a second time length;

determining whether or not the change duration time is longer than a predetermined time period;

setting an output start time point of image data to a latent image forming unit with an initial change of the detection signal subsequent to the start of the second period regarded as a reference, if the change duration time is longer than the predetermined time period, the latent image forming unit scanning and exposing the image carrier with light emitted in accordance with the image data, to form a latent image being a source of the toner image on the image carrier; and ignoring changes of the detection signal after the initial change of the detection signal subsequent to the start of the second period occurs.

8. A non-transitory computer readable medium storing a program that causes a computer to execute a process for detecting a reference index on a transfer body, the process comprising:

acquiring a detection signal from a detecting unit that is arranged so as to face a reference index formed on a transfer body on which a toner image held on an image carrier is transferred, the detecting unit outputting the detection signal changing in accordance with passing of the reference index;

starting, concurrently with a first change occurring in the detection signal thus acquired, a first period having a first time length during which changes occurring in the detection signal are ignored;

measuring change duration time from the first change occurring in the detection signal to a second change occurring after the first change;

starting, after an elapsing of the first period, a second period having a second time length;

determining whether or not the change duration time is longer than a predetermined time period;

setting an output start time point of image data to a latent image forming unit with an initial change of the detection signal subsequent to the start of the second period regarded as a reference, if the change duration time is longer than the predetermined time period, the latent image forming unit scanning and exposing the image carrier with light emitted in accordance with the image data, to form a latent image being a source of the toner image on the image carrier; and ignoring changes of the detection signal after the initial change of the detection signal subsequent to the start of the second period occurs.

9. The image forming apparatus according to claim 1, wherein the first change occurring in the detection signal comprises an assertion of the detection signal and the initial change of the detection signal subsequent to the start of the second period comprises a negation of the detection signal.

* * * * *